US006393392B1

(12) United States Patent
Minde

(10) Patent No.: US 6,393,392 B1
(45) Date of Patent: May 21, 2002

(54) MULTI-CHANNEL SIGNAL ENCODING AND DECODING

(75) Inventor: Tor Björn Minde, Gammelstad (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/407,599

(22) Filed: Sep. 28, 1999

(30) Foreign Application Priority Data

Sep. 30, 1998 (SE) ..... 9803321

(51) Int. Cl.[7] ..... G10L 19/08; G10L 19/12

(52) U.S. Cl. ..... 704/220; 704/219; 704/222

(58) Field of Search ..... 704/219, 220, 704/221, 222, 223, 226, 229, 214, 201; 702/185; 382/170

(56) References Cited

U.S. PATENT DOCUMENTS

| | | | | | |
|---|---|---|---|---|---|
| 4,636,799 | A | | 1/1987 | Kubick | 343/754 |
| 4,706,094 | A | | 11/1987 | Kubick | 343/754 |
| 5,105,372 | A | * | 4/1992 | Provost et al. | 702/185 |
| 5,235,647 | A | * | 8/1993 | Van de Kerkhof | 704/220 |
| 5,924,062 | A | * | 7/1999 | Maung | 704/219 |
| 6,104,321 | A | * | 8/2000 | Akagiri | 341/50 |
| 6,307,962 | B1 | * | 10/2001 | Parker et al. | 382/170 |

FOREIGN PATENT DOCUMENTS

| | | |
|---|---|---|
| EP | 0 797 324 A2 | 9/1997 |
| WO | WO 90/16136 | 12/1990 |
| WO | WO 93/10571 | 5/1993 |
| WO | WO 97/04621 | 2/1997 |

OTHER PUBLICATIONS

Gersho, A., "Advances in Speech and Audio Compression," Proc. of the IEEE, vol. 82, No. 6, pp. 900–916, Jun. 1994.
Spanias, A.S., "Speech Coding: A Tutorial Review," Proc. of the IEEE, vol. 82, Vo. 10, pp. 1541–1582, Oct. 1994.
Noll, P., "Wideband Speech and Audio Coding," IEEE Commun. Mag. vol. 31, No. 11, pp. 34–44, 1993.
Grill, B., et al., "Improved MPEG–2 Audio Multi–Channel Encoding," 96$^{th}$ Audio Engineering Society Convention, 1996.
Th. Ten Kate, W.R., et al., "Matrixing of Bit Rate Reduced Audio Signals," Proc. ICASSP, vol. 2, pp. 205–208, 1992.
Bosi, M., et al., "ISO/IEC MPEG–2 Advanced Audio Coding," 101$^{st}$ Audio Engineering Society Convention, 1996.
Sondhi, M. Mohan, et al., "Sterophonic Acoustic Echo Cancellation—An Overview of the Fundamental Problem," IEEE Signal Processing Letters, vol. 2, No. 8, Aug. 1995.
Kroon, P., et al., "A Class of Analysis–by–Synthesis Predictive Coders for High Quality Speech Coding at Rates Between 4.8 and 16 kbits/s," IEEE Journ. Sel. Areas Com., vol. SAC–6, No. 2, pp. 353–363, Feb. 1988.

(List continued on next page.)

*Primary Examiner*—Richemond Dorvil
*Assistant Examiner*—Daniel Nolan
(74) *Attorney, Agent, or Firm*—Jenkens & Gilchrist, P.C.

(57) ABSTRACT

A multi-channel signal encoder includes an analysis part with an analysis filter block having a matrix-valued transfer function with at least one non-zero non-diagonal element. The corresponding synthesis part includes a synthesis filter block (12M) having the inverse matrix-valued transfer function. This arrangement reduces both intra-channel redundancy and inter-channel redundancy in linear predictive analysis-by-synthesis signal encoding.

26 Claims, 14 Drawing Sheets

OTHER PUBLICATIONS

Laflamme, C., et al., "16 Kbps Wideband Speech Coding Technique Based on Algebraic CELP," Proc. ICASSP, pp. 13–16, 1991.

Krembel, L., EPO Standard Search Report, File No. RS 101759, Re: SEA 9803321, pp. 1–3, Mar. 30, 1999.

Stoll, G., et al., "MPEG–2 Audio: TheNew MPEG–1 Compatible Standard for Encoding of Digital Surround Sound for DAB, DVB and Computer Multimedia," ITG–Fachberichte, No. 133, pp. 153–160, Jan. 1, 1995, XP 000571182.

Benyassine, A., et al., "Multiband CELP Coding of Speech," Proceedings of the Asilomar Conference on Signals, Systems and Computers, Pacific Grove, Nov. 5–7, 1990, vol. 2, No. Conf. 24, pp. 644–648, Nov. 5, 1990. XP000280093.

Fuchs, H., "Improving Joint Stero Audio Coding by Adaptive Inter–Channel Prediction," IEEE Workshop on Applications of Signal Processing to Audio Acoustics, pp. 39–42, Oct. 17, 1993, XP000570718.

Ikeda, K. et al., "Audio Transfer System on PHS Using Error–Protected Stereo Twin VQ," 1998 International Conference on Consumer Electronics, Los Angeles, CA, USA, Jun. 2–4, 1998, vol. 44, No. 3, pp. 1032–1038, XP002097383, ISSN 0098–3063, IEEE Transactions on Consumer Electronics, IEEE, USA, Aug. 1998.

Bengtsson, R., International Search Report, International App. No. PCT/SE99/02067, Mar. 24, 2000, pp. 1–3.

* cited by examiner

MULTI-CHANNEL SIGNAL ENCODING AND DECODING

TECHNICAL FIELD

The present invention relates to encoding and decoding of multi-channel signals, such as stereo audio signals.

BACKGROUND OF THE INVENTION

Existing speech coding methods are generally based on single-channel speech signals. An example is the speech coding used in a connection between a regular telephone and a cellular telephone. Speech coding is used on the radio link to reduce bandwidth usage on the frequency limited air-interface. Well known examples of speech coding are PCM (Pulse Code Modulation), ADPCM (Adaptive Differential Pulse Code Modulation), sub-band coding, transform coding, LPC (Linear Predictive Coding) vocoding, and hybrid coding, such as CELP (Code-Excited Linear Predictive) coding. See A. Gersho, "Advances in Speech and Audio Compression", Proc. of the IEEE, Vol. 82, No. 6, pp. 900–918, June 1994; A. S. Spanias, "Speech Coding: A Tutorial Review", Proc. of the IEEE, Vol. 82, No. 10, pp. 1541–1582, October 1994.

In an environment where the audio/voice communication uses more than one input signal, for example a computer workstation with stereo loudspeakers and two microphones (stereo microphones), two audio/voice channels are required to transmit the stereo signals. Another example of a multi-channel environment would be a conference room with two, three or four channel input/output. These types of applications are expected to be used on the internet and in third generation cellular systems.

From the area of music coding it is known that correlated multi-channels are more efficiently coded if a joint coding technique is used, an overview is given in P. Noll, "Wide-band Speech and Audio Coding", IEEE Commun. Mag. Vol. 31, No. 11, pp. 34–44, 1993. In B. Grill et al., "Improved MPEG-2 Audio Multi-Channel Encoding", 96$^{th}$ Audio Engineering Society Convention, pp. 1–9, 1994, W. R. Th. Ten Kate et al., "Matrixing of Bit Rate Reduced Audio Signals", Proc. ICASSP, Vol. 2, pp. 205–208, 1992, and M. Bosi et al., "ISO/IEC MPEG-2 Advanced Audio Coding", 101$^{st}$ Audio Engineering Society Convention, 1996 a technique called matrixing (or sum and difference coding) is used. Prediction is also used to reduce inter-channel redundancy, see B. Grill et al., "Improved MPEG-2 Audio Multi-Channel Encoding", 96$^{th}$ Audio Engineering Society Convention, pp. 1–9, 1994, W. R. Th. Ten Kate et al., "Matrixing of Bit Rate Reduced Audio Signals", Proc. ICASSP, Vol. 2, pp. 205–208, 1992, M. Bosi et al., "ISO/IEC MPEG-2 Advanced audio Coding", 101$^{st}$ Audio Engineering Society Convention, 1996, and EP 0 797 324 A2, Lucent Technologies, Inc., "Enhanced stereo coding method using temporal envelope shaping", where the prediction is used for intensity coding or spectral prediction. Another technique known from WO 90/16136, British Teleom., "Polyphonic Coding" uses time aligned sum and difference signals and prediction between channels. Furthermore, prediction has been used to remove redundancy between channels in waveform coding methods. See WO 97/04621, Robert Bosch Gmbh, "Process for reducing redundancy during the coding of multi-channel signals and device for decoding redundancy reduced multi-channel signals". The problem of stereo channels is also encountered in the echo cancellation area, an overview is given in M Mohan Sondhi et al., "Stereophonic Acoustic Echo Cancellation—An Overview of the Fundamental Problem", IEEE Signal Processing Letters, Vol. 2, No. 8, August 1995.

From the described state of the art it is known that a joint coding technique will exploit the inter-channel redundancy. This feature has been used for audio (music) coding at higher bit rates and in connection with waveform coding, such as sub-band coding in MPEG. To reduce the bit rate further, below M (the number of channels) times 16–20 kb/s, and to do this for wideband (approximately 7 kHz) or narrowband (3–4 kHz) signals requires a more efficient coding technique.

SUMMARY OF THE INVENTION

An object of the present invention is to reduce the coding bit rate in multi-channel analysis-by-synthesis signal coding from M (the number of channels) times the coding bit rate of a single (mono) channel bit rate to a lower bit rate.

This object is solved in accordance with the appended claims.

Briefly, the present invention involves generalizing different elements in a single-channel linear predictive analysis-by-synthesis (LPAS) encoder with their multi-channel counterparts. The most fundamental modifications are the analysis and synthesis filters, which are replaced by filter blocks having matrix-valued transfer functions. These matrix-valued transfer functions will have non-diagonal matrix elements that reduce inter-channel redundancy. Another fundamental feature is that the search for best coding parameters is performed closed-loop (analysis-by-synthesis).

BRIEF DESCRIPTION OF THE DRAWINGS

The invention, together with further objects and advantages thereof, may best be understood by making reference to the following description taken together with the accompanying drawings, in which.

DETAILED DESCRIPTION OF THE PREFERRED EMBODIMENTS

Figure 1:
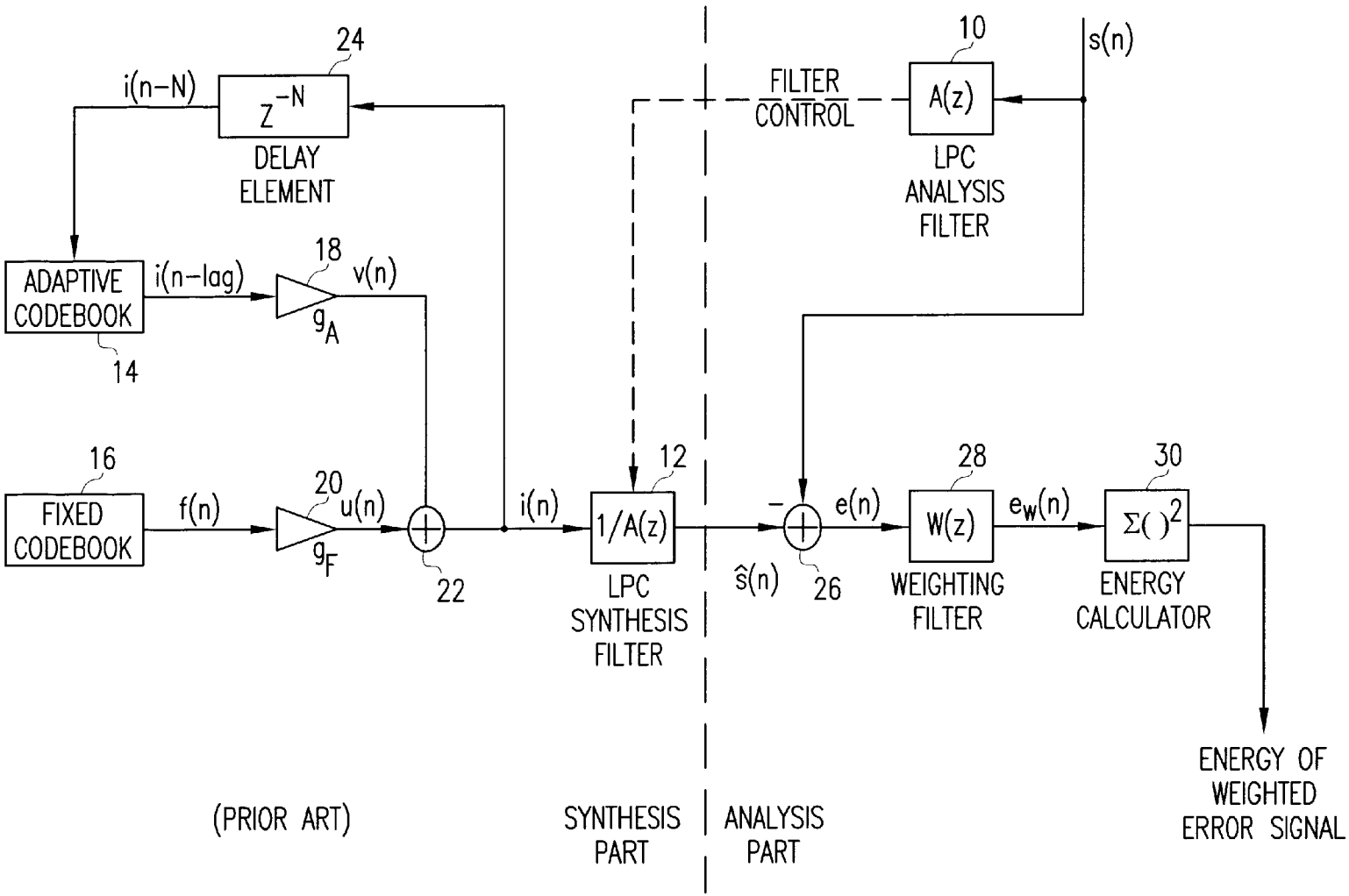
FIG. 1 is a block diagram of a conventional single-channel LPAS speech encoder.

The present invention will now be described by introducing a conventional single-channel linear predictive analysis-by-synthesis (LPAS) speech encoder, and by describing modifications in each block of this encoder that will transform it into a multi-channel LPAS speech encoder FIG. 1 is a block diagram of a conventional single-channel LPAS speech encoder, see P. Kroon, E. Deprettere, "A Class of Analysis-by-Synthesis Predictive Coders for High Quality Speech Coding at Rates Between 4.8 and 16 kbits/s", IEEE Journ. Sel. Areas Co., Vol SAC-6, No. 2, pp 353–363, February 1988 for a more detailed description. The encoder comprises two parts, namely a synthesis part and an analysis part (a corresponding decoder will contain only a synthesis part).

The synthesis part comprises a LPC synthesis filter 12, which receives an excitation signal i(n) and outputs a synthetic speech signal ŝ(n). Excitation signal i(n) is formed by adding two signals u(n) and v(n) in an adder 22. Signal u(n) is formed by scaling a signal f(n) from a fixed codebook 16 by a gain $g_F$ in a gain element 20. Signal v(n) is formed by scaling a delayed (by delay "lag") version of excitation signal i(n) from an adaptive codebook 14 by a gain $g_A$ in a gain element 18. The adaptive codebook is formed by a feedback loop including a delay element 24, which delays excitation signal i(n) one sub-frame length N. Thus, the adaptive codebook will contain past excitations i(n) that are shifted into the codebook (the oldest excitations are shifted out of the codebook and discarded). The LPC synthesis filter parameters are typically updated every 20–40 ms frame, while the adaptive codebook is updated every 5–10 ms sub-frame.

The analysis part of the LPAS encoder performs an LPC analysis of the incoming speech signal s(n) and also performs an excitation analysis.

The LPC analysis is performed by an LPC analysis filter 10. This filter receives the speech signal s(n) and builds a parametric model of this signal on a frame-by-frame basis. The model parameters are selected so as to minimize the energy of a residual vector formed by the difference between an actual speech frame vector and the corresponding signal vector produced by the model. The model parameters are represented by the filter coefficients of analysis filter 10. These filter coefficients define the transfer function A(z) of the filter. Since the synthesis filter 12 has a transfer function that is at least approximately equal to 1/A(z), these filter coefficients will also control synthesis filter 12, as indicated by the dashed control line.

The excitation analysis is performed to determine the best combination of fixed codebook vector (codebook index), gain $g_F$, adaptive codebook vector (lag) and gain $g_A$ that results in the synthetic signal vector {ŝ(n)} that best matches speech signal vector {s(n)} (here { } denotes a collection of samples forming a vector or frame). This is done in an exhaustive search that tests all possible combinations of these parameters (sub-optimal search schemes, in which some parameters are determined independently of the other parameters and then kept fixed during the search for the remaining parameters, are also possible). In order to test how close a synthetic vector {ŝ(n)} is to the corresponding speech vector {s(n)}, the energy of the difference vector {e(n)} (formed in an adder 26) may be calculated in an energy calculator 30. However, it is more efficient to consider the energy of a weighted error signal vector $\{e_w(n)\}$, in which the errors has been re-distributed in such a way that large errors are masked by large amplitude frequency bands. This is done in weighting filter 28.

The modification of the single-channel LPAS encoder of FIG. 1 to a multi-channel LPAS encoder in accordance with the present invention will now be described with reference to FIGS. 2–13. A two-channel (stereo) speech signal will be assumed, but the same principles may also be used for more than two channels.

Figure 2:
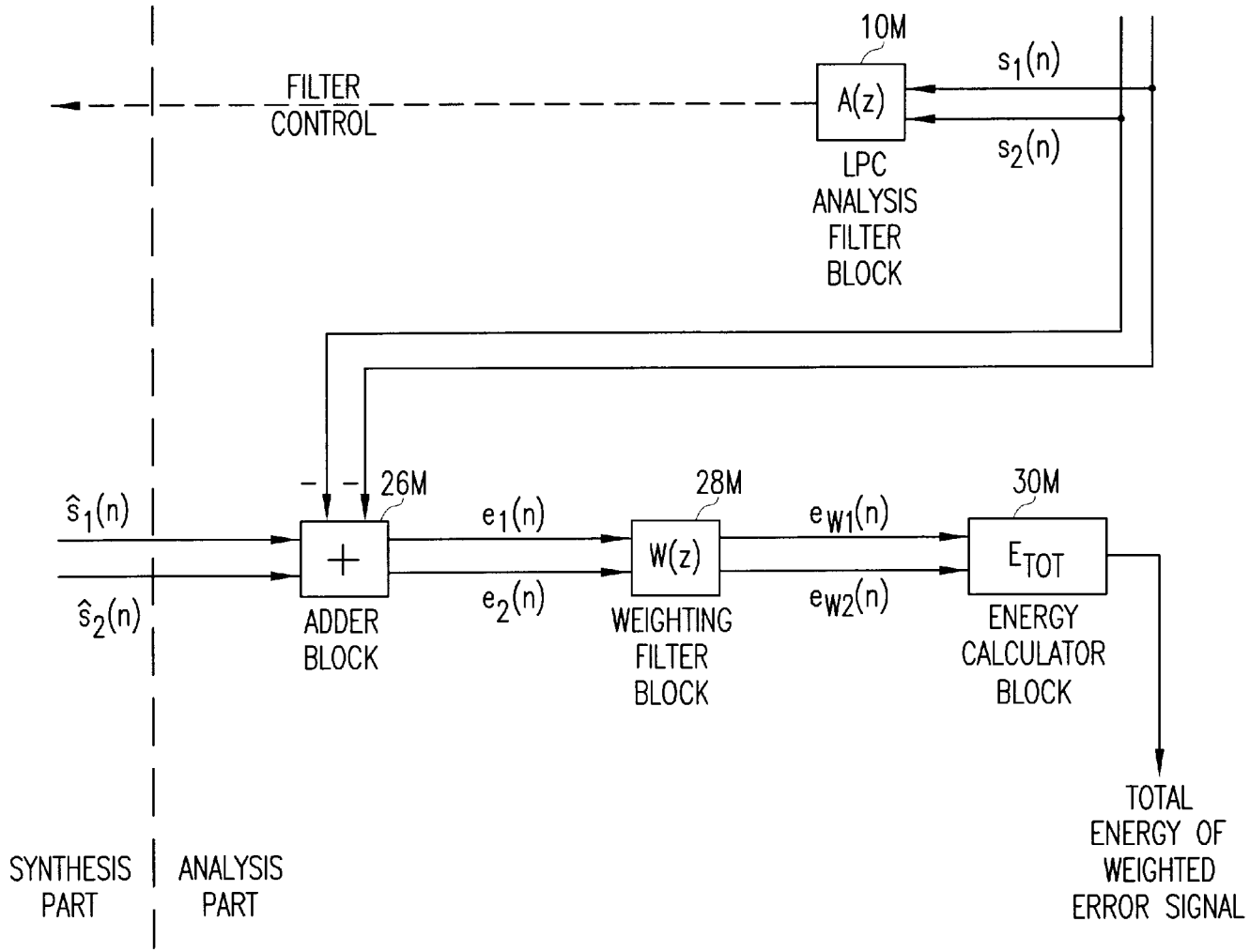
FIG. 2 is a block diagram of an embodiment of the analysis part of a multi-channel LPAS speech encoder in accordance with the present invention.

FIG. 2 is a block diagram of an embodiment of the analysis part of a multi-channel LPAS speech encoder in accordance with the present invention. In FIG. 2 the input signal is now a multi-channel signal, as indicated by signal components $s_1(n)$, $s_2(n)$. The LPC analysis filter 10 in FIG. 1 has been replaced by a LPC analysis filter block 10M having a matrix-valued transfer function A(z). This block will be described in further detail with reference to FIG. 5. Similarly, adder 26, weighting filter 28 and energy calculator 30 are replaced by corresponding multi-channel blocks 26M, 28M and 30M, respectively. These blocks are described in further detail in FIGS. 4, 6 and 7, respectively.

Figure 3:
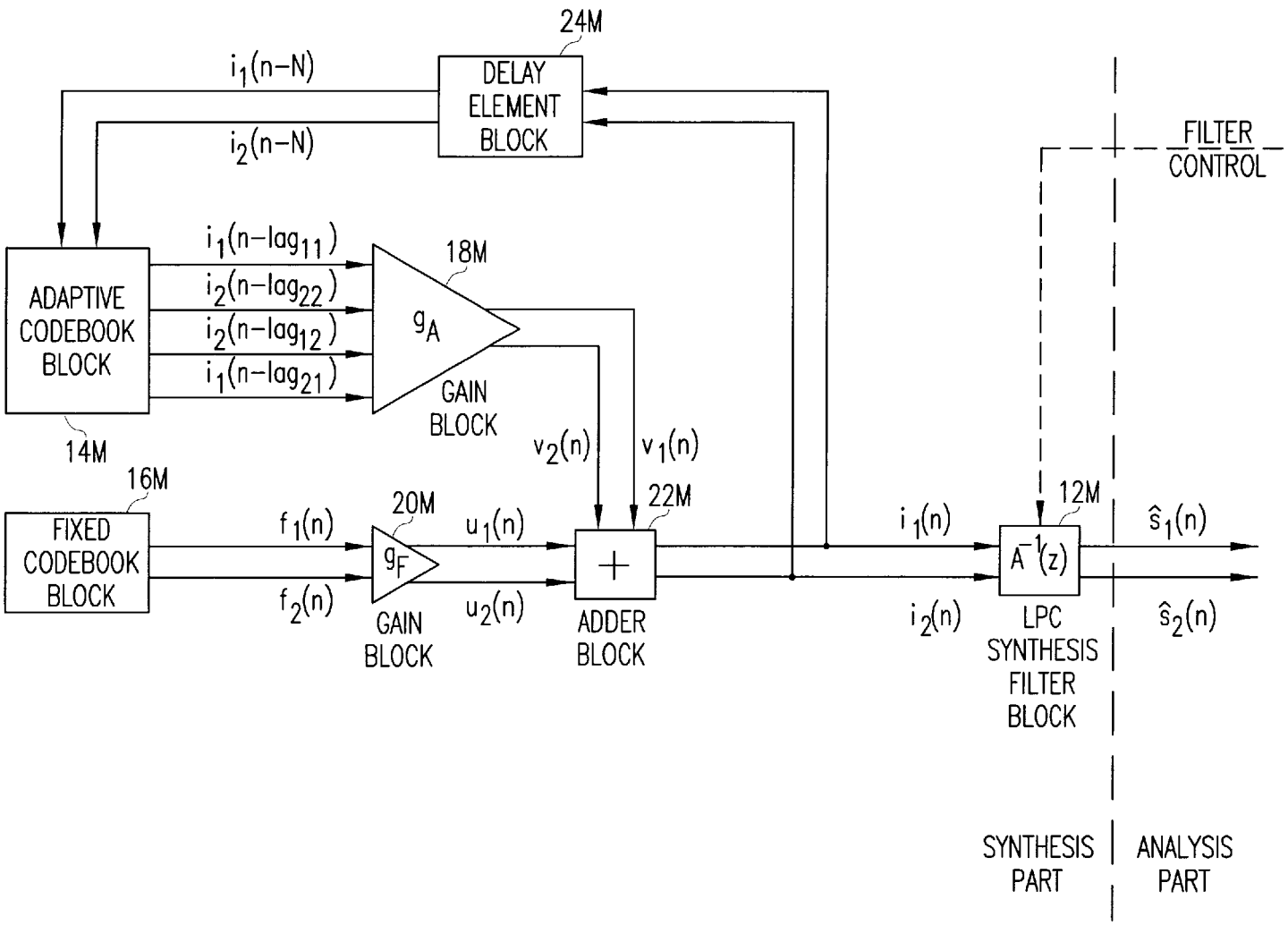
FIG. 3 is a block diagram of an exemplary embodiment of the synthesis part of a multi-channel LPAS speech encoder in accordance with the present invention.

FIG. 3 is a block diagram of an embodiment of the synthesis part of a multi-channel LPAS speech encoder in accordance with the present invention. A multi-channel decoder may also be formed by such a synthesis part. Here LPC synthesis filter 12 in FIG. 1 has been replaced by a LPC synthesis filter block 12M having a matrix-valued transfer function $A^{-1}(z)$, which is (as indicated by the notation) at least approximately equal to the inverse of A(z). This block will be described in further detail with reference to FIG. 8. Similarly, adder 22, fixed codebook 16, gain element 20, delay element 24, adaptive codebook 14 and gain element 18 are replaced by corresponding multi-channel blocks 22M, 16M, 24M, 14M and 18M, respectively. These blocks are described in further detail in FIGS. 4, and 9–11.

Figure 4:
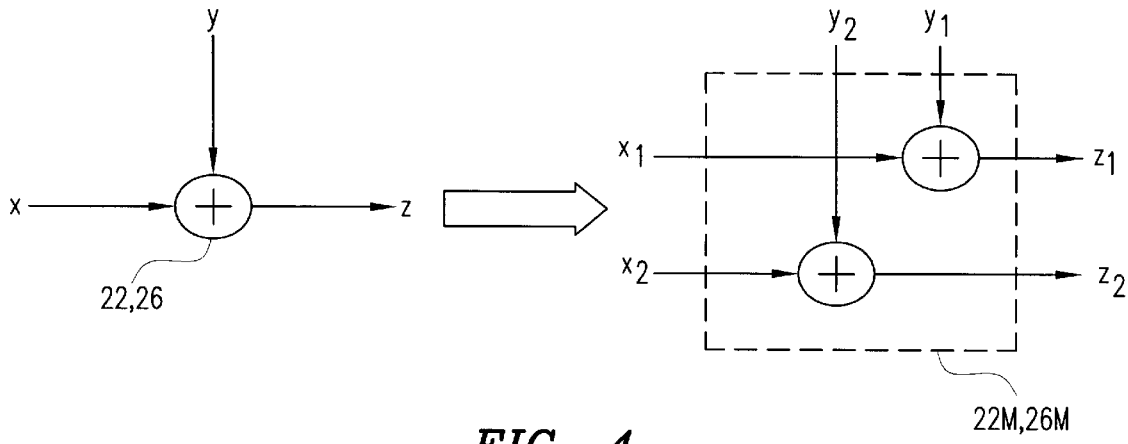
FIG. 4 is a block diagram illustrating modification of a single-channel signal adder to provide a multi-channel signal adder block.

FIG. 4 is a block diagram illustrating a modification of a single-channel signal adder to a multi-channel signal adder block. This is the easiest modification, since it only implies increasing the number of adders to the number of channels to be encoded. Only signals corresponding to the same channel are added (no inter-channel processing).

Figure 5:
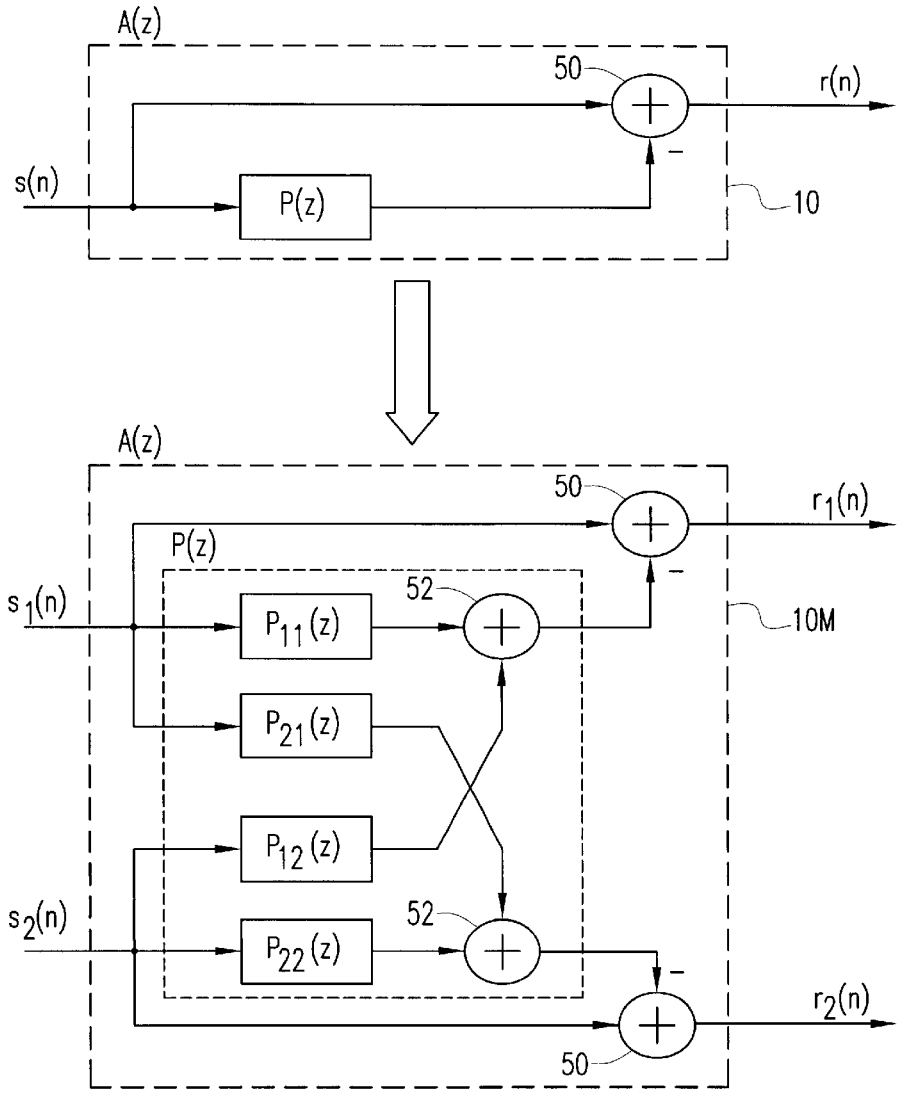
FIG. 5 is a block diagram illustrating modification of a single-channel LPC analysis filter to provide a multi-channel LPC analysis filter block.

FIG. 5 is a block diagram illustrating a modification of a single-channel LPC analysis filter to a multi-channel LPC analysis filter block. In the single-channel case (upper part of FIG. 5) a predictor P(z) is used to predict a model signal that is subtracted from speech signal s(n) in an adder 50 to produce a residual signal r(n). In the multi-channel case (lower part of FIG. 5) there are two such predictors $P_{11}(z)$ and $P_{22}(z)$ and two adders 50. However, such a multi-channel LPC analysis block would treat the two channels as completely independent and would not exploit the inter-channel redundancy. In order to exploit this redundancy, there are two inter-channel predictors $P_{12}(z)$ and $P_{21}(z)$ and two further adders 52. By adding the inter-channel predictions to the intra-channel predictions in adders 52, more accurate predictions are obtained, which reduces the variance (error) of the residual signals $r_1(n)$, $r_2(n)$. The purpose of the multi-channel predictor formed by predictors $P_{11}(z)$, $P_{22}(z)$, $P_{12}(Z)$, $P_{21}(z)$ is to minimize the sum of $r_1(n)^2+r_2(n)^2$ over a speech frame. The predictors (which do not have to be of the same order) may be calculated by using multi-channel extensions of known linear prediction analysis. One example may be found in [9], which describes a reflection coefficient based predictor. The prediction coefficients are efficiently coded with a multi-dimensional vector quantizer, preferably after transformation to a suitable domain, such as the line spectral frequency domain.

Mathematically the LPC analysis filter block may be expressed (in the z-domain) as:

$$\begin{pmatrix} R_1(z) \\ R_2(z) \end{pmatrix} = \begin{pmatrix} S_1(z) - P_{11}(z)S_1(z) - P_{12}(z)S_2(z) \\ S_2(z) - P_{21}(z)S_1(z) - P_{22}(z)S_2(z) \end{pmatrix}$$
$$= \begin{pmatrix} 1 - P_{11}(z) & -P_{12}(z) \\ -P_{21}(z) & 1 - P_{22}(z) \end{pmatrix} \begin{pmatrix} S_1(z) \\ S_2(z) \end{pmatrix}$$
$$= \left( \begin{pmatrix} 1 & 0 \\ 0 & 1 \end{pmatrix} - \begin{pmatrix} P_{11}(z) & P_{12}(z) \\ P_{21}(z) & P_{22}(z) \end{pmatrix} \right) \begin{pmatrix} S_1(z) \\ S_2(z) \end{pmatrix}$$
$$= (E - P(z)) \begin{pmatrix} S_1(z) \\ S_2(z) \end{pmatrix} = A(z) \begin{pmatrix} S_1(z) \\ S_2(z) \end{pmatrix}$$

(here E denotes the unit matrix) or in compact vector notation:

$$R(z)=A(z)S(z)$$

From these expressions it is clear that the number of channels may be increased by increasing the dimensionality of the vectors and matrices.

Figure 6:
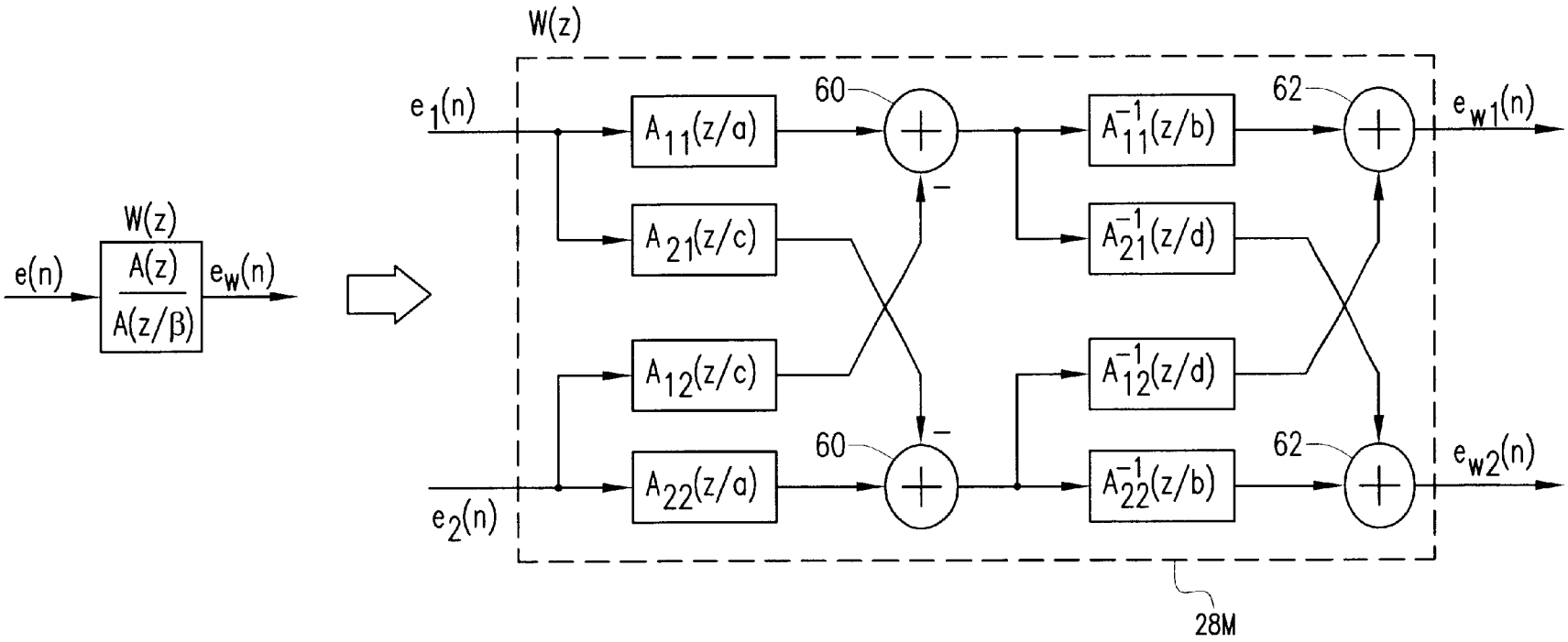
FIG. 6 is a block diagram illustrating modification of a single-channel weighting filter to provide a multi-channel weighting filter block.

FIG. 6 is a block diagram illustrating a modification of a single-channel weighting filter to a multi-channel weighting filter block. A single-channel weighting filter 28 typically has a transfer function of the form:

$$W(z) = \frac{A(z)}{A(z/\beta)}$$

where β is a constant, typically in the range 0.8–1.0. A more general form would be:

$$W(z) = \frac{A(z/\alpha)}{A(z/\beta)}$$

where $\alpha \geqq \beta$ is another constant, typically also in the range 0.8–1.0. A natural modification to the multi-channel case is:

$$W(z)=A^{-1}(z/\beta)A(z/\alpha)$$

where W(z), $A^{-1}(z)$ and A(z) are now matrix-valued. A more flexible solution, which is the one illustrated in FIG. 6, uses factors a and b (corresponding to α and β above) for intra-channel weighting and factors c and d for inter-channel weighting (all factors are typically in the range 0.8–1.0). Such a weighting filter block may mathematically be expressed as:

$$W(z) = \begin{pmatrix} A_{11}^{-1}(z/b) & A_{12}^{-1}(z/d) \\ A_{21}^{-1}(z/d) & A_{22}^{-1}(z/b) \end{pmatrix} \begin{pmatrix} A_{11}(z/a) & A_{12}(z/c) \\ A_{21}(z/c) & A_{22}(z/a) \end{pmatrix}$$

From this expression it is clear that the number of channels may be increased by increasing the dimensionality of the matrices and introducing further factors.

Figure 7:
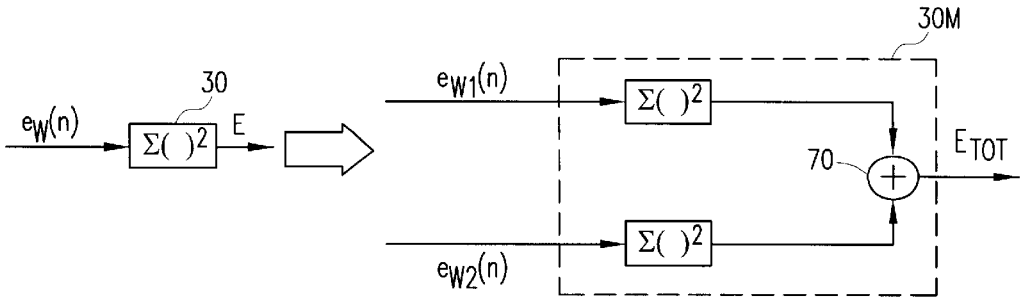
FIG. 7 is a block diagram illustrating modification of a single-channel energy calculator to provide a multi-channel energy calculator block.

FIG. 7 is a block diagram illustrating a modification of a single-channel energy calculator to a multi-channel energy calculator block. In the single-channel case energy calculator 12 determines the sum of the squares of the individual samples of the weighted error signal $e_W(n)$ of a speech frame. In the multi-channel case energy calculator 12M similarly determines the energy of a frame of each component $e_{W1}(n)$, $e_{W2}(n)$ in elements 70, and adds these energies in an adder 72 for obtaining the total energy $E_{TOT}$.

Figure 8:
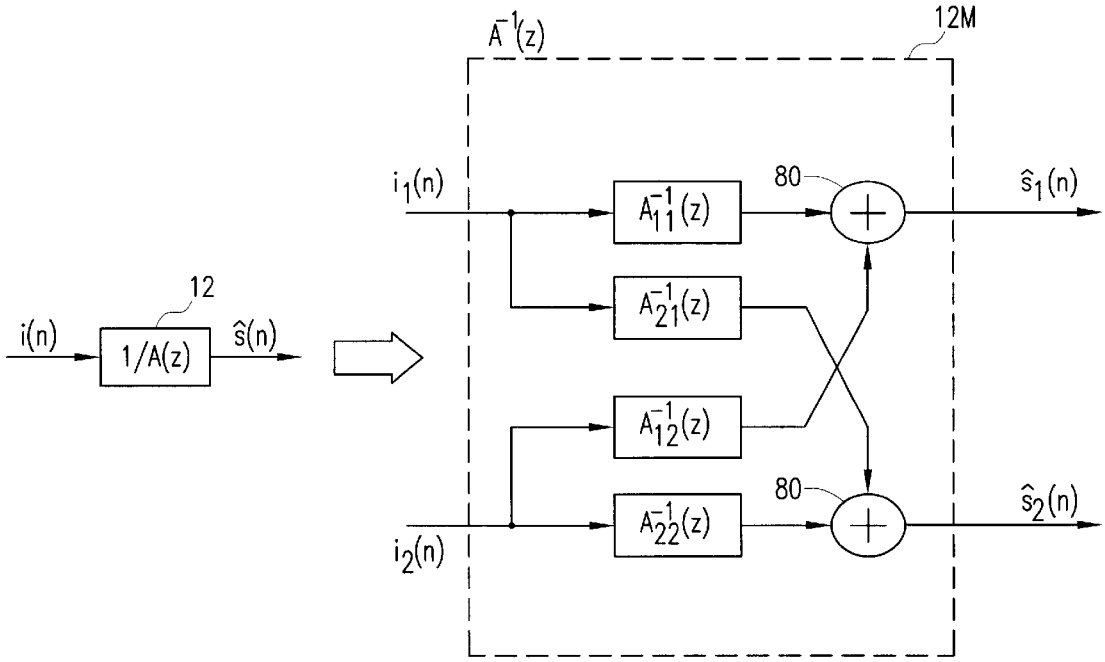
FIG. 8 is a block diagram illustrating modification of a single-channel LPC synthesis filter to provide a multi-channel LPC synthesis filter block.

FIG. 8 is a block diagram illustrating a modification of a single-channel LPC synthesis filter to a multi-channel LPC synthesis filter block. In the single-channel encoder in FIG. 1 the excitation signal i(n) should ideally be equal to the residual signal r(n) of the single-channel analysis filter in the upper part of FIG. 5. If this condition is fulfilled, a synthesis filter having the transfer function 1/A(z) would produce an estimate ŝ(n) that would be equal to speech signal s(n). Similarly, in the multi-channel encoder the excitation signal $i_1(n)$, $i_2(n)$ should ideally be equal to the residual signal $r_1(n)$, $r_2(n)$ in the lower part of FIG. 5. In this case a modification of synthesis filter 12 in FIG. 1 is a synthesis filter block 12M having a matrix-valued transfer function. This block should have a transfer function that at least approximately is the (matrix) inverse $A^{-1}(z)$ of the matrix-valued transfer function A(z) of the analysis block in FIG. 5. Mathematically the synthesis block may be expressed (in the z-domain) as:

$$\begin{pmatrix} \hat{S}_1(z) \\ \hat{S}_2(z) \end{pmatrix} = \begin{pmatrix} A_{11}^{-1}(z) & A_{12}^{-1}(z) \\ A_{21}^{-1}(z) & A_{22}^{-1}(z) \end{pmatrix} \begin{pmatrix} I_1(z) \\ I_2(z) \end{pmatrix}$$

or in compact vector notation:

$$\hat{S}(z)=A^{-1}(z)I(z)$$

From these expressions it is clear that the number of channels may be increased by increasing the dimensionality of the vectors and matrices.

Figure 9:
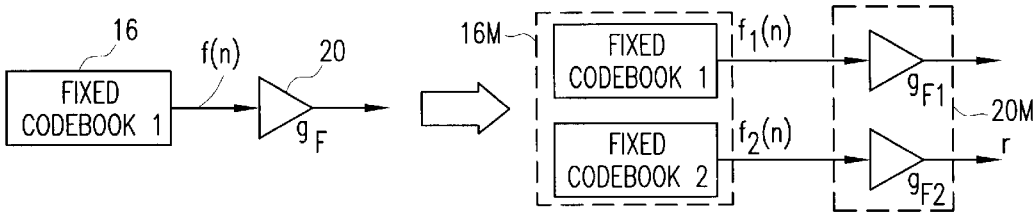
FIG. 9 is a block diagram illustrating modification of a single-channel fixed codebook to provide a multi-channel fixed codebook block.

FIG. 9 is a block diagram illustrating a modification of a single-channel fixed codebook to a multi-channel fixed codebook block. The single fixed codebook in the single-channel case is formally replaced by a fixed multi-codebook 16M. However, since both channels carry the same type of signal, in practice it is sufficient to have only one fixed codebook and pick different excitations $f_1(n)$, $f_2(n)$ for the two channels from this single codebook. The fixed codebook may, for example, be of the algebraic type. See C. Laflamme et. al., "16 Kbps Wideband Speech Coding Technique Based on Algebraic CELP", Proc. ICASSP, 1991, pp 13–16. Furthermore, the single gain element 20 in the single-channel case is replaced by a gain block 20M containing several gain elements. Mathematically the gain block may be expressed (in the time domain) as:

$$\begin{pmatrix} u_1(n) \\ u_2(n) \end{pmatrix} = \begin{pmatrix} g_{F1} & 0 \\ 0 & g_{F2} \end{pmatrix} \begin{pmatrix} f_1(n) \\ f_2(n) \end{pmatrix}$$

or in compact vector notation:

$$u(n)=g_F f(n)$$

From these expressions it is clear that the number of channels may be increased by increasing the dimensionality of the vectors and matrices.

Figure 10:
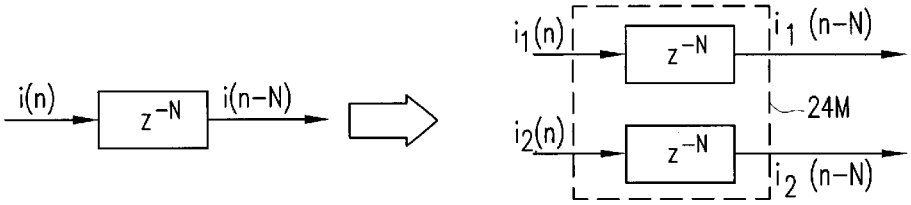
FIG. 10 is a block diagram illustrating modification of a single-channel delay element to provide a multi-channel delay element block.

FIG. 10 is a block diagram illustrating a modification of a single-channel delay element to a multi-channel delay element block. In this case a delay element is provided for each channel. All signals are delayed by the sub-frame length N.

Figure 11:
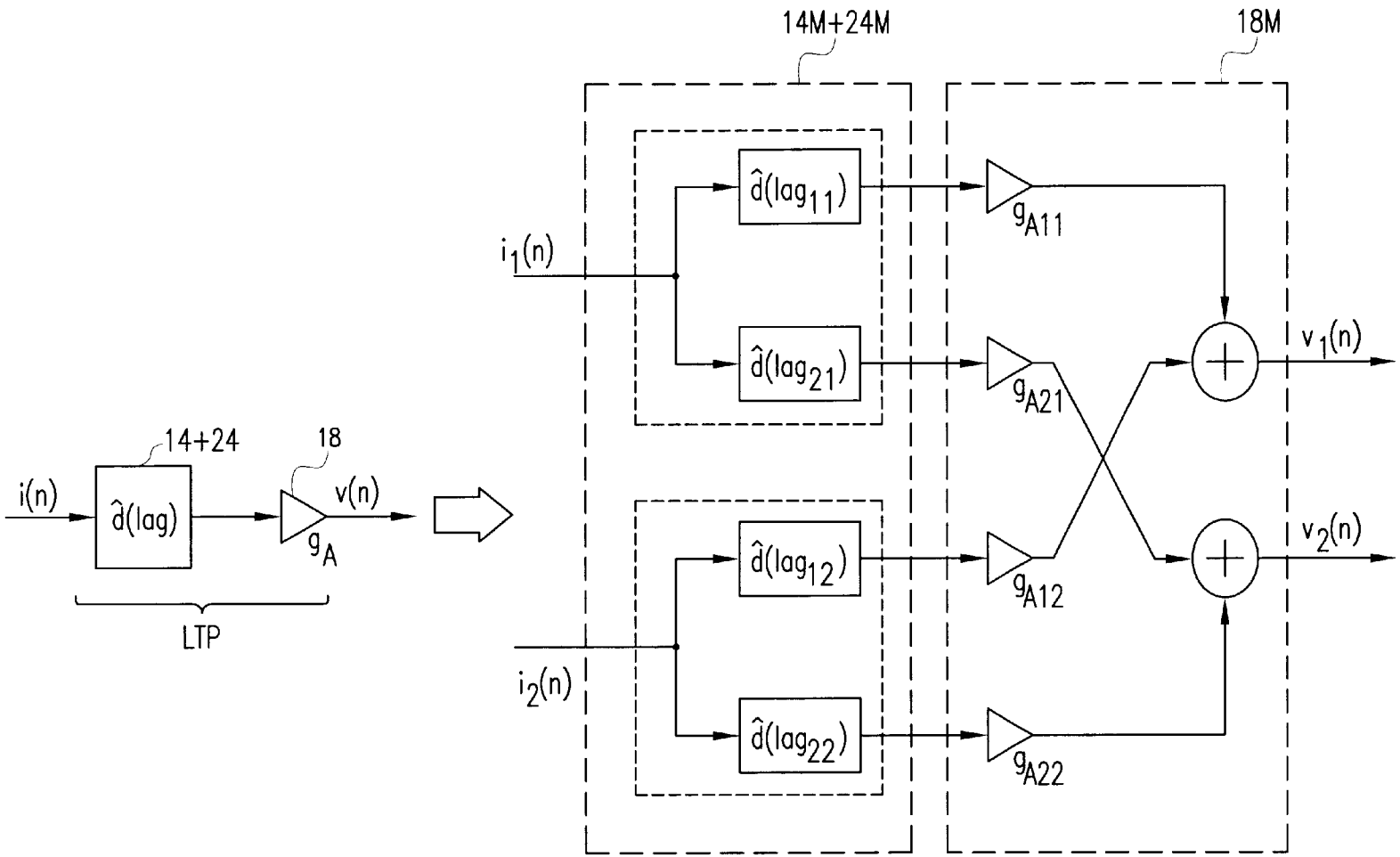
FIG. 11 is a block diagram illustrating modification of a single-channel long-term predictor synthesis block to provide a multi-channel long-term predictor synthesis block.

FIG. 11 is a block diagram illustrating a modification of a single-channel long-term predictor synthesis block to a multi-channel long-term predictor synthesis block. In the single-channel case the combination of adaptive codebook 14, delay element 24 and gain element 18 may be considered as a long term predictor LTP. The action of these three blocks may be expressed mathematically (in the time domain) as:

$$v(n)=g_A i(n-lag)=g_A \hat{d}(lag) i(n)$$

where $\hat{d}$ denotes a time shift operator. Thus, excitation v(n) is a scaled (by $g_A$), delayed (by lag) version of innovation i(n). In the multi-channel case there are different delays $lag_{11}$, $lag_{22}$ for the individual components $i_1(n)$, $i_2(n)$ and there are also cross-connections of $i_1(n)$, $i_2(n)$ having separate delays $lag_{11}$, $lag_{22}$ for modeling inter-channel correlation. Furthermore, these four signals may have different gains $g_{A11}$, $g_{A22}$, $g_{A12}$, $g_{A21}$. Mathematically the action of the multi-channel long-term predictor synthesis block may be expressed (in the time domain) as:

$$\begin{pmatrix} v_1(n) \\ v_2(n) \end{pmatrix} = \begin{pmatrix} g_{A11} i_1(n-lag_{11}) + g_{A12} i_2(n-lag_{12}) \\ g_{A22} i_2(n-lag_{22}) + g_{A22} i_1(n-lag_{21}) \end{pmatrix}$$

$$= \left[ \begin{pmatrix} g_{A11} & g_{A12} \\ g_{A21} & g_{A22} \end{pmatrix} \otimes \begin{pmatrix} \hat{d}(lag_{11}) & \hat{d}(lag_{12}) \\ \hat{d}(lag_{21}) & \hat{d}(lag_{22}) \end{pmatrix} \right] \begin{pmatrix} i_1(n) \\ i_2(n) \end{pmatrix}$$

or in compact vector notation:

$$v(n) = \left[ g_A \otimes \hat{d} \right] i(n)$$

where $\otimes$ denotes element-wise matrix multiplication, and $\hat{d}$ denotes a matrix-valued time shift operator.

From these expressions it is clear that the number of channels may be increased by increasing the dimensionality of the vectors and matrices. To achieve lower complexity or lower bitrate, joint coding of lags and gains can be used. The lag may, for example, be delta-coded, and in the extreme case only a single lag may be used. The gains may be vector quantized or differentially encoded.

Figure 12:
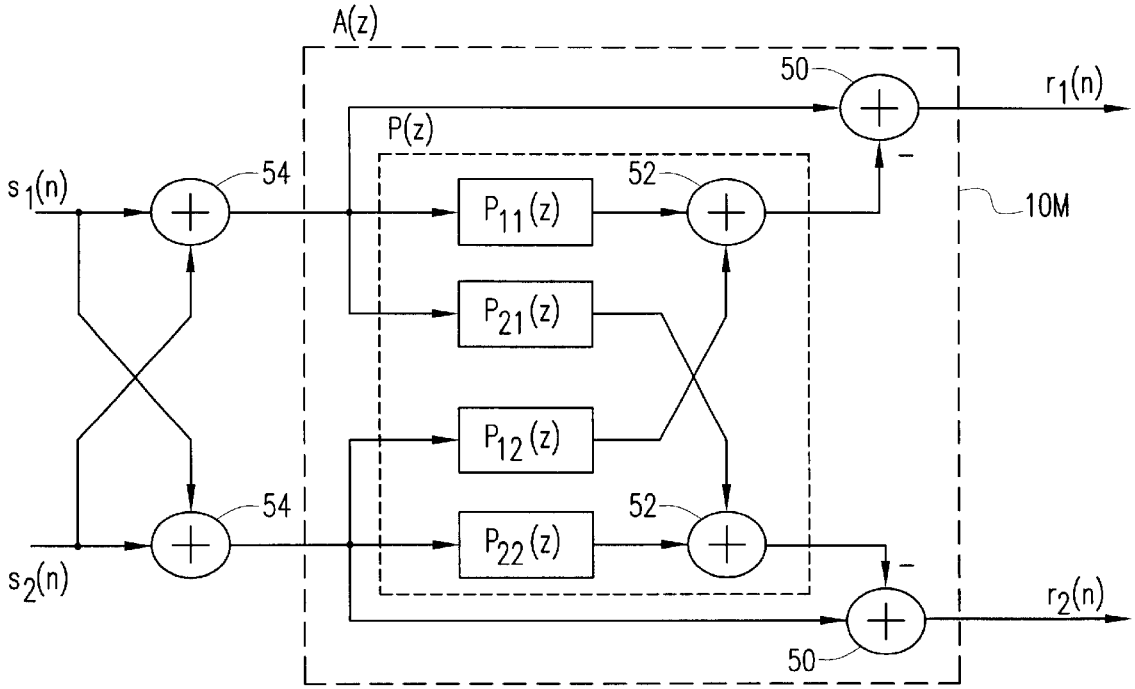
FIG. 12 is a block diagram illustrating another embodiment of a multi-channel LPC analysis filter block.

FIG. 12 is a block diagram illustrating another embodiment of a multi-channel LPC analysis filter block. In this embodiment the input signal $s_1(n)$, $s_2(n)$ is pre-processed by forming the sum and difference signals $s_1(n)+s_2(n)$ and $s_1(n)-S_2(n)$, respectively, in adders 54. Thereafter these sum and difference signals are forwarded to the same analysis filter block as in FIG. 5. This will make it possible to have different bit allocations between the (sum and difference) channels, since the sum signal is expected to be more complex than the difference signal. Thus, the sum signal predictor $P_{11}(z)$ will typically be of higher order than the difference signal predictor $P_{22}(z)$. Furthermore, the sum signal predictor will require a higher bit rate and a finer quantizer. The bit allocation between the sum and difference channels may be either fixed or adaptive. Since the sum and difference signals may be considered as a partial orthogonalization, the cross-correlation between the sum and difference signals will also be reduced, which leads to simpler (lower order) predictors $P_{12}(z)$, $P_{21}(z)$. This will also reduce the required bit rate.

Figure 13:
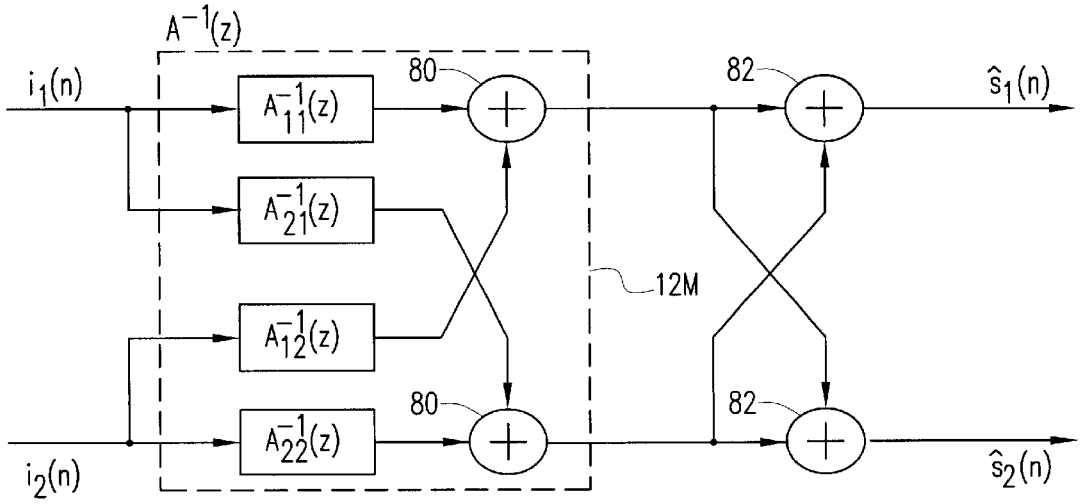
FIG. 13 is a block diagram illustrating an embodiment of a multi-channel LPC synthesis filter block corresponding to the analysis filter block of FIG. 12.

FIG. 13 is a block diagram illustrating an embodiment of a multi-channel LPC synthesis filter block corresponding to the analysis filter block of FIG. 12. Here the output signals from a synthesis filter block in accordance with FIG. 8 is post-processed in adders 82 to recover estimates $\hat{s}_1(n)$, $\hat{s}_2(n)$ from estimates of sum and difference signals. The embodiments described with reference to FIGS. 12 and 13 are a special case of a general technique called matrixing. The general idea behind matrixing is to transform the original vector valued input signal into a new vector valued signal, the component signals of which are less correlated (more orthogonal) than the original signal components. Typical examples of transformations are Hadamard and Walsh transforms. For example, Hadamard transformation matrices of order 2 and 4 are given by:

$$H_2 = \begin{pmatrix} 1 & 1 \\ 1 & -1 \end{pmatrix} \qquad H_4 = \begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

It is noted that the Hadamard matrix $H_2$ gives the embodiment of FIG. 12. The Hadamard matrix $H_4$ would be used for 4-channel coding. The advantage of this type of matrixing is that the complexity and required bit rate of the encoder are reduced without the need to transmit any information on the transformation matrix to the decoder, since the form of the matrix is fixed (a full orthogonalization of the input signals would require time-varying transformation matrices, which would have to be transmitted to the decoder, thereby increasing the required bit rate). Since the transformation matrix is fixed, its inverse, which is used at the decoder, will also be fixed and may therefore be pre-computed and stored at the decoder.

A variation of the above described sum and difference technique is to code the "left" channel and the difference between the "left" and "right" channel multiplied by a gain factor, i.e.

$$C_1(n)=L(n)$$

$$C_2(n)=L(n)-\text{gain}\cdot R(n)$$

where L, R are the left and right channels, $C_1$, $C_2$ are the resulting channels to be encoded and gain is a scale factor. The scale factor may be fixed and known to the decoder or may be calculated or predicted, quantized and transmitted to the decoder. After decoding of $C_1$, $C_2$ at the decoder the left and right channels are reconstructed in accordance with $$\hat{L}(n)=\hat{C}_1(n)$$

$$\hat{R}(n)=(\hat{L}(n)-\hat{C}_2(n))/\text{gain}$$

where "^" denotes estimated quantities. In fact this technique may also be considered as a special case of matrixing where the transformation matrix is given by $$\begin{pmatrix} 1 & 0 \\ 1 & -\text{gain} \end{pmatrix}$$

This technique may also be extended to more than two dimensions. In the general case the transformation matrix is given by $$\begin{pmatrix} 1 & 0 & 0 & \cdots & 0 \\ 1 & -gain_{22} & 0 & \cdots & 0 \\ 1 & -gain_{32} & -gain_{33} & \cdots & 0 \\ \vdots & \vdots & \vdots & \vdots & \vdots \\ 1 & -gain_{N2} & -gain_{N3} & \cdots & -gain_{NN} \end{pmatrix}$$

where N denotes the number of channels.

In the case where matrixing is used the resulting "channels" may be very dissimilar. Thus, it may be desirable to treat them differently in the weighting process. In this case a more general weighting matrix in accordance with $$W(z) = \begin{pmatrix} A_{11}^{-1}(z/\beta_{11}) & A_{12}^{-1}(z/\beta_{12}) \\ A_{21}^{-1}(z/\beta_{21}) & A_{22}^{-1}(z/\beta_{22}) \end{pmatrix} \begin{pmatrix} A_{11}(z/\alpha_{11}) & A_{12}(z/\alpha_{12}) \\ A_{21}(z/\alpha_{21}) & A_{22}(z/\alpha_{22}) \end{pmatrix}$$

may be used. Here the elements of matrices $$\begin{pmatrix} \alpha_{11} & \alpha_{12} \\ \alpha_{21} & \alpha_{22} \end{pmatrix} \text{ and } \begin{pmatrix} \beta_{11} & \beta_{12} \\ \beta_{21} & \beta_{22} \end{pmatrix}$$

typically are in the range 0.6–1.0. From these expressions it is clear that the number of channels may be increased by increasing the dimensionality of the weighting matrix. Thus, in the general case the weighting matrix may be written as:

$$W(z) = \begin{pmatrix} A_{11}^{-1}(z/\beta_{11}) & A_{12}^{-1}(z/\beta_{12}) & A_{13}^{-1}(z/\beta_{13}) & \cdots & A_{1N}^{-1}(z/\beta_{1N}) \\ A_{21}^{-1}(z/\beta_{21}) & A_{22}^{-1}(z/\beta_{22}) & A_{23}^{-1}(z/\beta_{23}) & \cdots & A_{2N}^{-1}(z/\beta_{2N}) \\ A_{31}^{-1}(z/\beta_{31}) & A_{32}^{-1}(z/\beta_{32}) & A_{33}^{-1}(z/\beta_{33}) & \cdots & A_{3N}^{-1}(z/\beta_{3N}) \\ \vdots & \vdots & \vdots & \vdots & \vdots \\ A_{N1}^{-1}(z/\beta_{N1}) & A_{N2}^{-1}(z/\beta_{N2}) & A_{N3}^{-1}(z/\beta_{N3}) & \cdots & A_{NN}^{-1}(z/\beta_{NN}) \end{pmatrix} \times$$

$$\begin{pmatrix} A_{11}(z/\alpha_{11}) & A_{12}(z/\alpha_{12}) & A_{13}(z/\alpha_{13}) & \cdots & A_{1N}(z/\alpha_{1N}) \\ A_{21}(z/\alpha_{21}) & A_{22}(z/\alpha_{22}) & A_{23}(z/\alpha_{23}) & \cdots & A_{2N}(z/\alpha_{2N}) \\ A_{31}(z/\alpha_{31}) & A_{32}(z/\alpha_{32}) & A_{33}(z/\alpha_{33}) & \cdots & A_{3N}(z/\alpha_{3N}) \\ \vdots & \vdots & \vdots & \vdots & \vdots \\ A_{N1}(z/\alpha_{N1}) & A_{N2}(z/\alpha_{N2}) & A_{N3}(z/\alpha_{N3}) & \cdots & A_{NN}(z/\alpha_{NN}) \end{pmatrix}$$

where N denotes the number of channels. It is noted that all the previously given examples of weighting matrices are special cases of this more general matrix.

Figure 14:
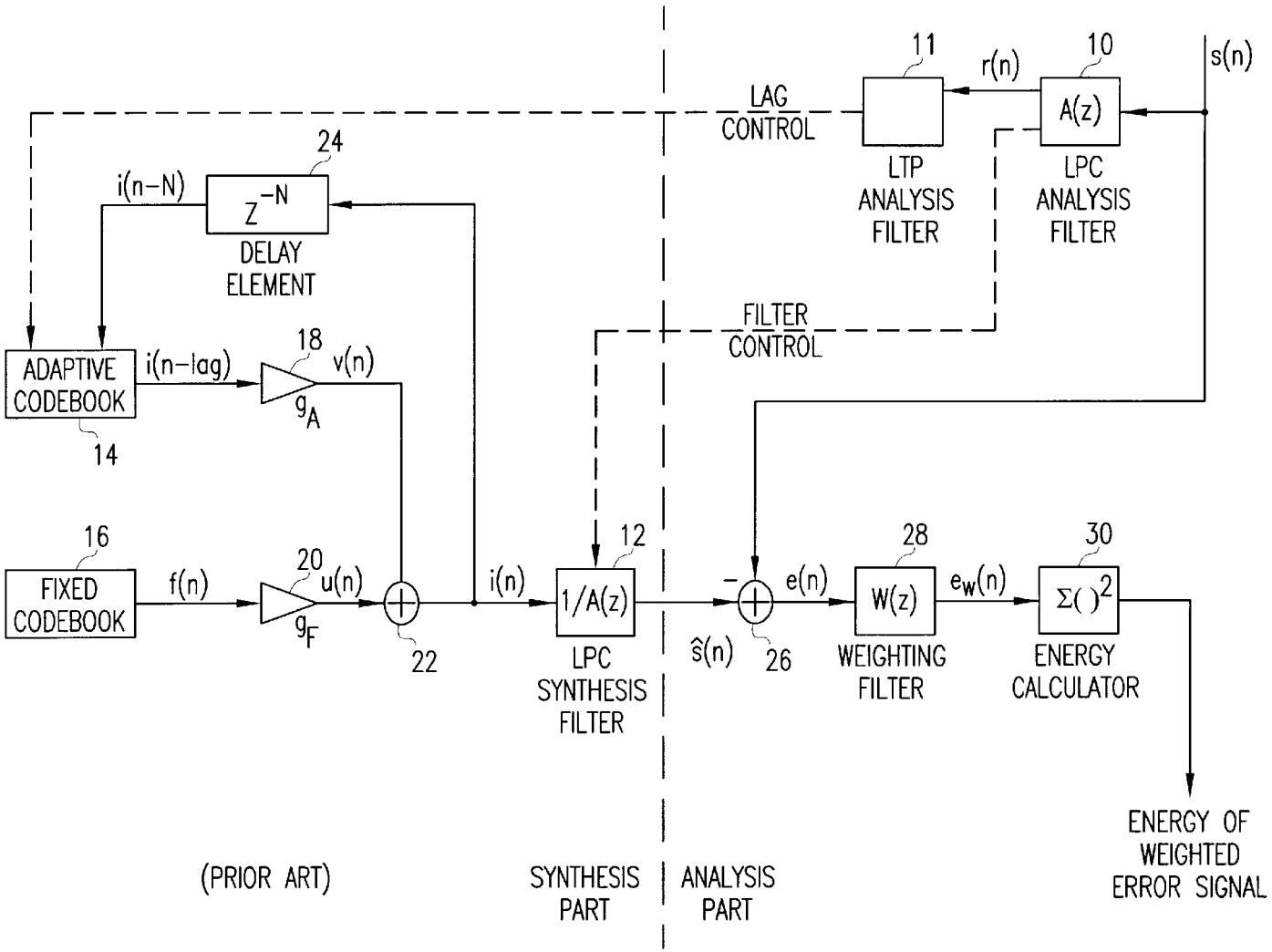
FIG. 14 is a block diagram of a another conventional single-channel LPAS speech encoder.

FIG. 14 is a block diagram of another conventional single-channel LPAS speech encoder. The essential difference between the embodiments of FIGS. 1 and 14 is the implementation of the analysis part. In FIG. 14 a long-term predictor (LTP) analysis filter 11 is provided after LPC analysis filter 10 to further reduce redundancy in residual signal r(n). The purpose of this analysis is to find a probable lag-value in the adaptive codebook. Only lag-values around this probable lag-value will be searched (as indicated by the dashed control line to the adaptive codebook 14), which substantially reduces the complexity of the search procedure.

Figure 15:
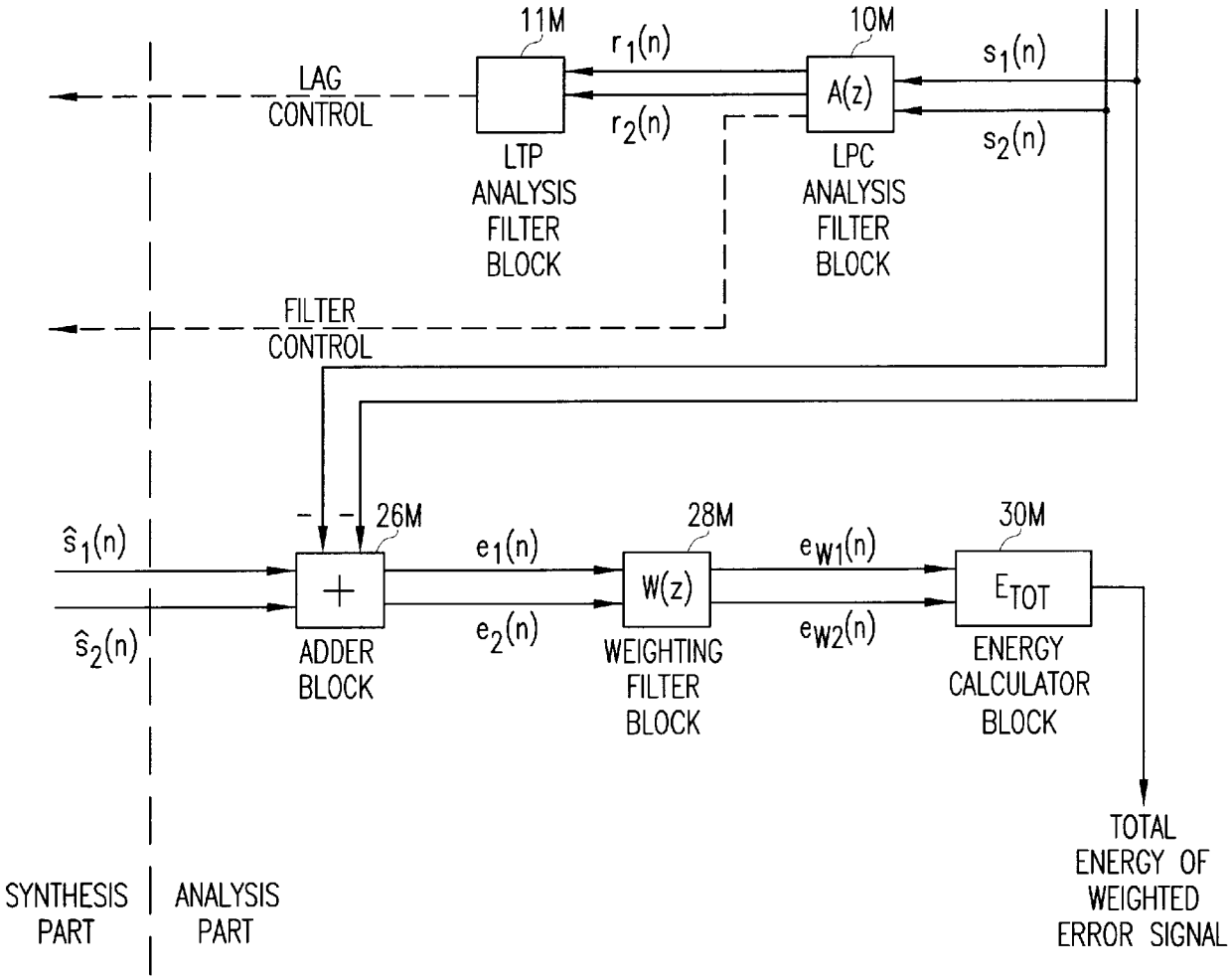
FIG. 15 is a block diagram of an exemplary embodiment of the analysis part of a multi-channel LPAS speech encoder in accordance with the present invention.

FIG. 15 is a block diagram of an exemplary embodiment of the analysis part of a multi-channel LPAS speech encoder in accordance with the present invention. Here the LTP analysis filter block 11M is a multi-channel modification of LTP analysis filter 11 in FIG. 14. The purpose of this block is to find probable lag-values ($lag_{11}$, $lag_{12}$, $lag_{21}$, $lag_{22}$), which will substantially reduce the complexity of the search procedure, which will be further described below.

Figure 16:
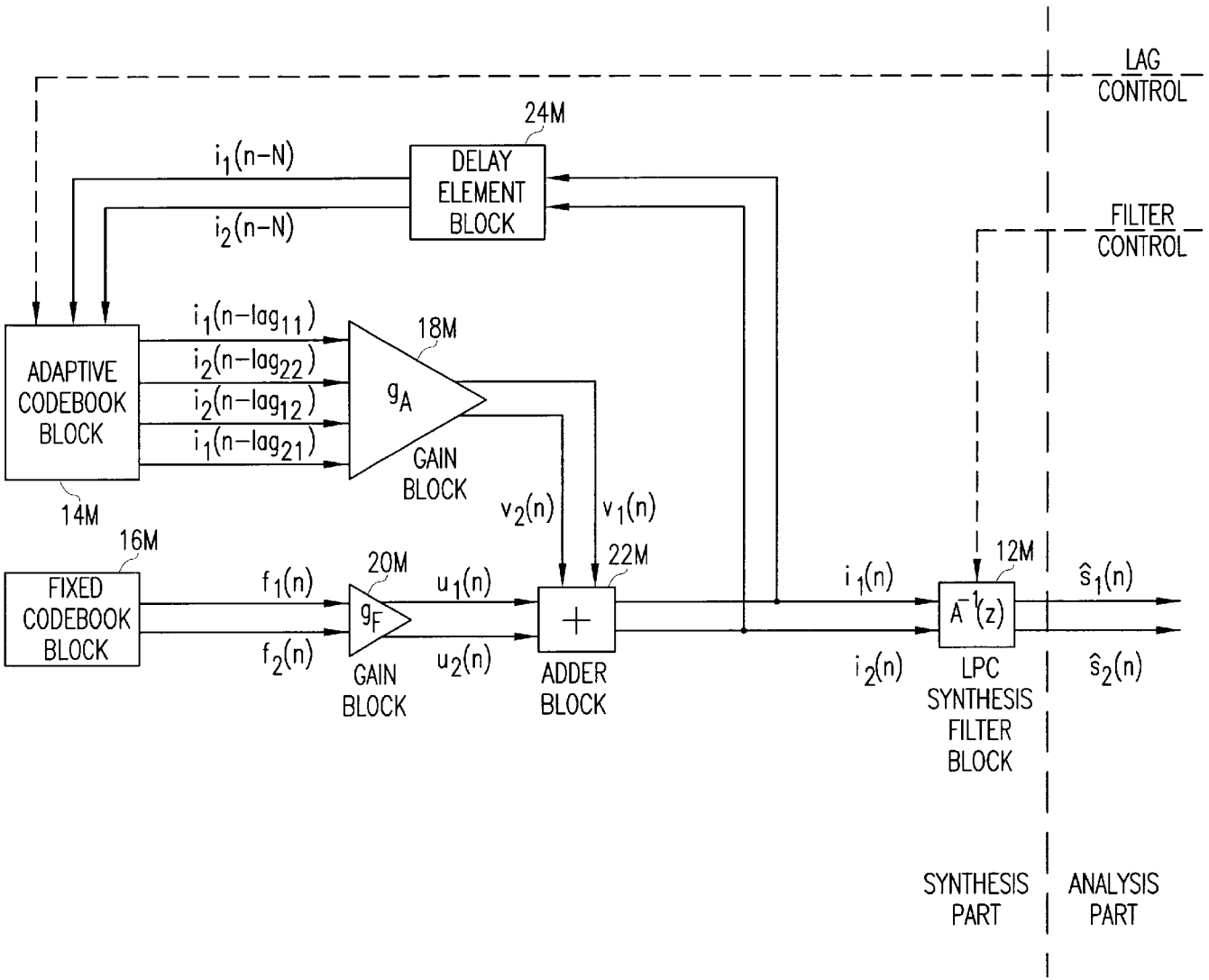
FIG. 16 is a block diagram of an exemplary embodiment of the synthesis part of a multi-channel LPAS speech encoder in accordance with the present invention.

FIG. 16 is a block diagram of an exemplary embodiment of the synthesis part of a multi-channel LPAS speech encoder in accordance with the present invention. The only difference between this embodiment and the embodiment in FIG. 3 is the lag control line from the analysis part to the adaptive codebook 14M.

Figure 17:
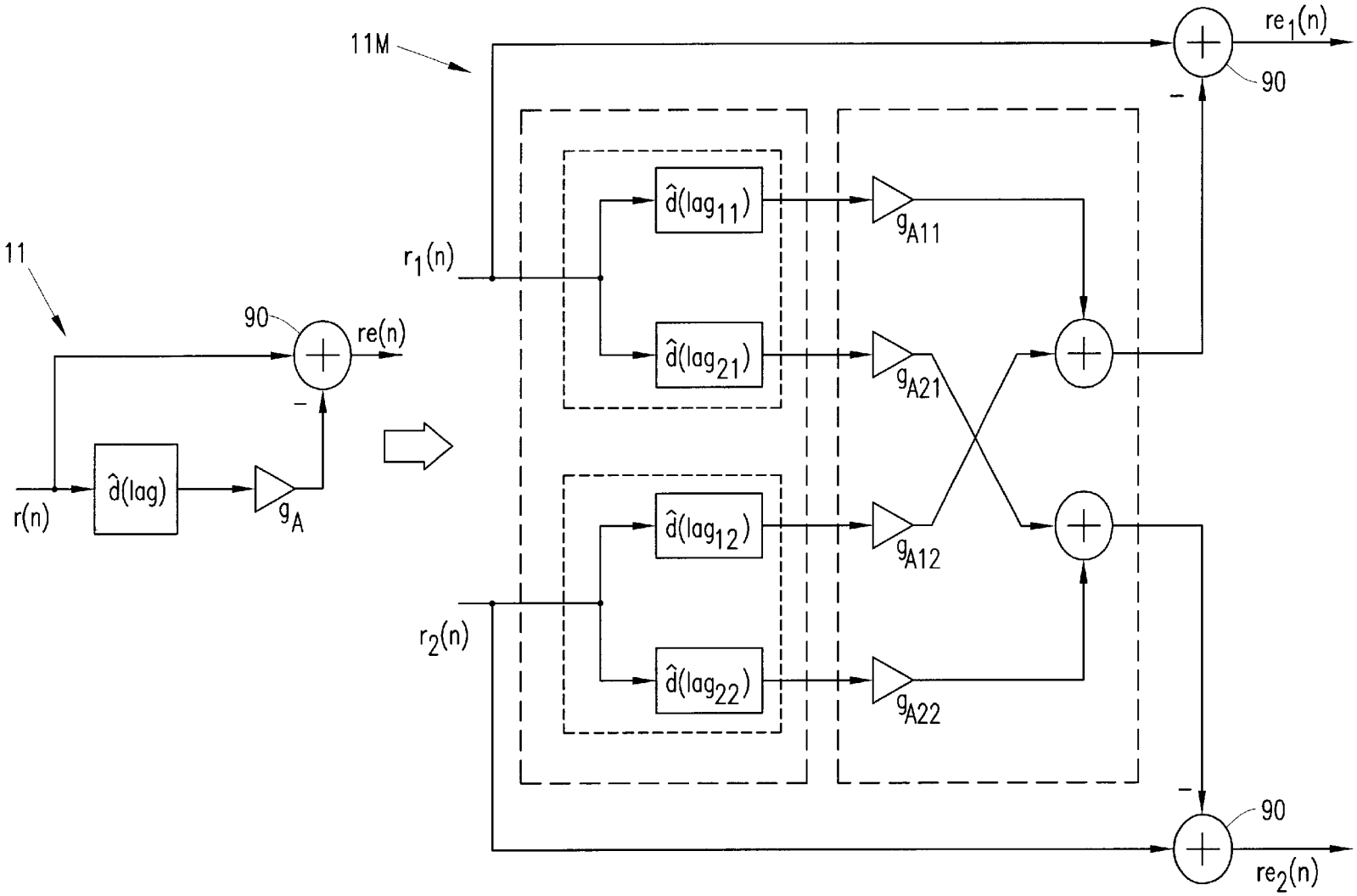
FIG. 17 is a block diagram illustrating modification of the single-channel long-term predictor analysis filter in FIG. 14 to provide the multi-channel long-term predictor analysis filter block in FIG. 15.

FIG. 17 is a block diagram illustrating a modification of the single-channel LTP analysis filter 11 in FIG. 14 to the multi-channel LTP analysis filter block 11M in FIG. 15. The left part illustrates a single-channel LTP analysis filter 11. By selecting a proper lag-value and gain-value, the squared sum of residual signals re(n), which are the difference between the signals r(n) from LPC analysis filter 12 and the predicted signals, over a frame is minimized. The obtained lag-value controls the starting point of the search procedure. The right part of FIG. 17 illustrates the corresponding multi-channel LTP analysis filter block 11M. The principle is the same, but here it is the energy of the total residual signal that is minimized by selecting proper values of lags $lag_{11}$, $lag_{12}$, $lag_{21}$, $lag_{22}$ and gain factors $g_{A11}$, $g_{A12}$, $g_{A21}$, $g_{A22}$. The obtained lag-values controls the starting point of the search procedure. Note the similarity between block 11M and the multi channel long-term predictor 18M in FIG. 11.

Having described the modification of different elements in a single-channel LPAS encoder to corresponding blocks in a multi-channel LPAS encoder, it is now time to discuss the search procedure for finding optimal coding parameters.

The most obvious and optimal search method is to calculate the total energy of the weighted error for all possible combination of $lag_{11}$, $lag_{12}$, $lag_{21}$, $lag_{22}$, $g_{A11}$, $g_{A12}$, $g_{A21}$, $g_{A22}$, two fixed codebook indices, $g_{F1}$ and $g_{F2}$, and to select the combination that gives the lowest error as a representation of the current speech frame. However, this method is very complex, especially if the number of channels is increased.

Figure 18:
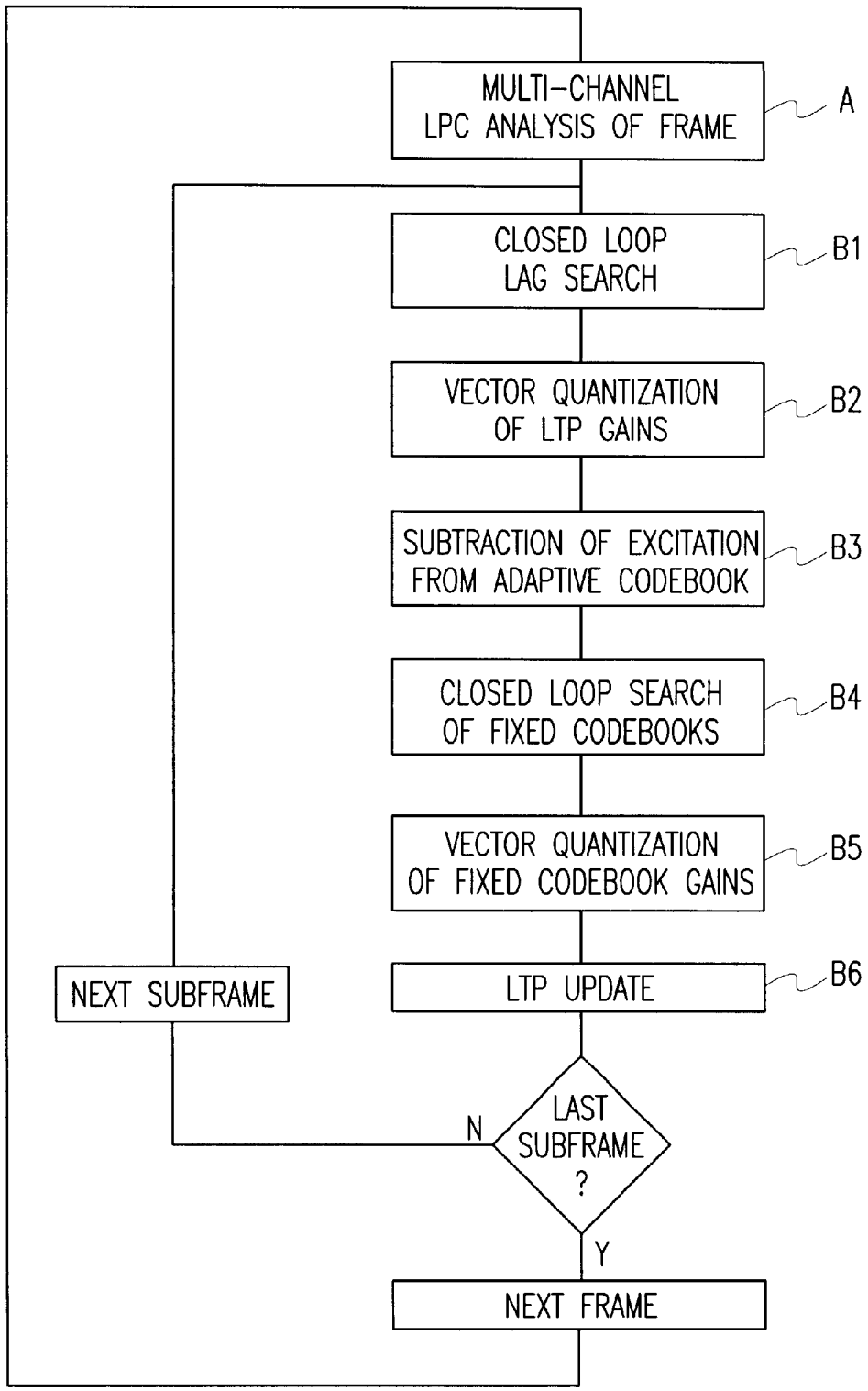
FIG. 18 is a flow chart illustrating an exemplary embodiment of a search method in accordance with the present invention.

A less complex, sub-optimal method suitable for the embodiment of FIGS. 2–3 is the following algorithm (subtraction of filter ringing is assumed and not explicitly mentioned), which is also illustrated in FIG. 18:

A. Perform multi-channel LPC analysis for a frame (for example 20 ms)

B. For each sub-frame (for example 5 ms) perform the following steps:

B1. Perform an exhaustive (simultaneous and complete) search of all possible lag-values in a closed loop search;

B2. Vector quantize LTP gains;

B3. Subtract contribution to excitation from adaptive codebook (for the just determined lags/gains) in remaining search in fixed codebook;

B4. Perform exhaustive search of fixed codebook indices in a closed loop search;

B5. Vector quantize fixed codebook gains;

B6. Update LTP.

Figure 19:
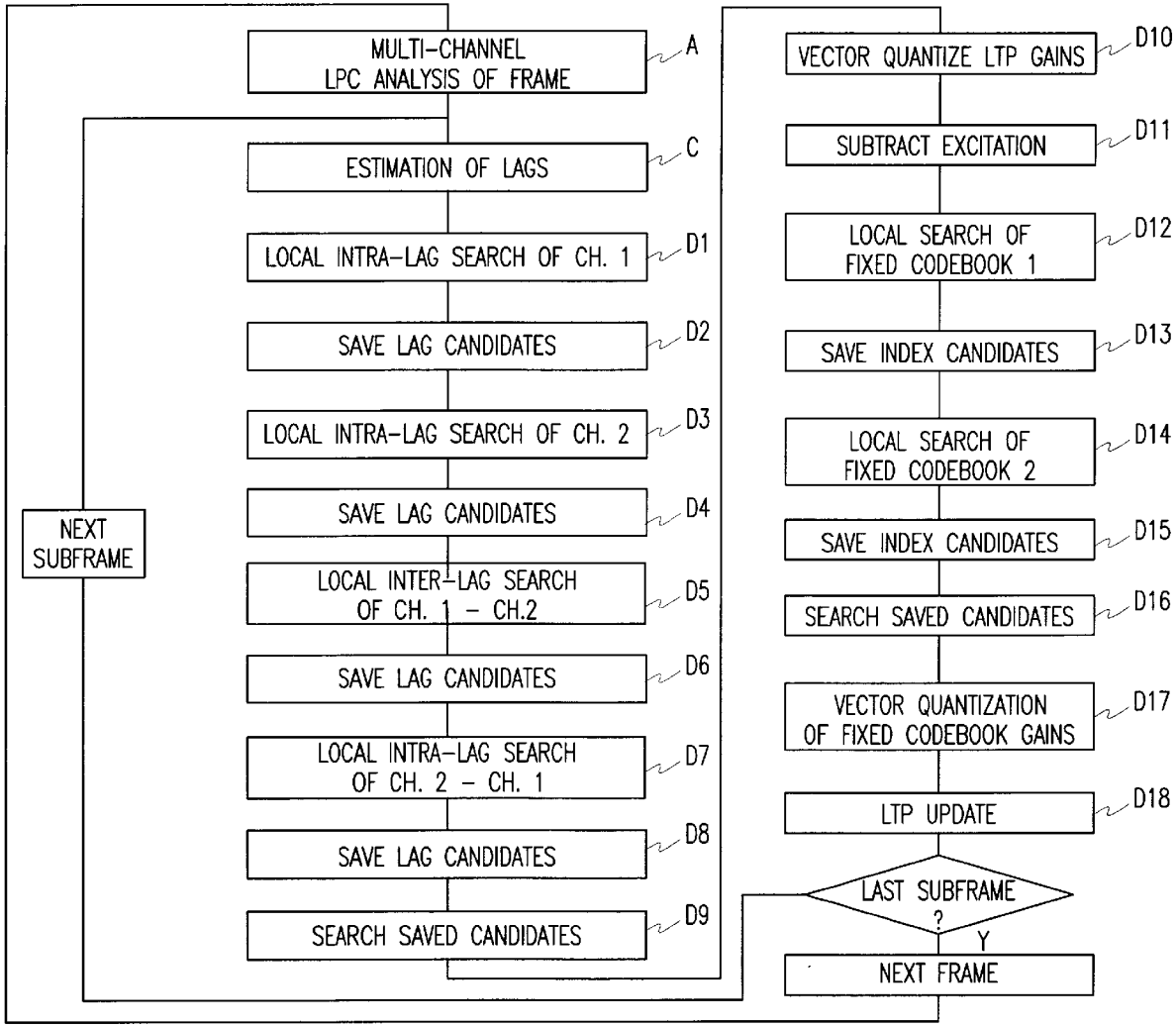
FIG. 19 is a flow chart illustrating another exemplary embodiment of a search method in accordance with the present invention.

A less complex, sub-optimal method suitable for the embodiment of FIGS. 15–16 is the following algorithm (subtraction of filter ringing is assumed and not explicitly mentioned), which is also illustrated in FIG. 19:

A. Perform multi-channel LPC analysis for a frame

C. Determine (open loop) estimates of lags in LTP analysis (one set of estimates for entire frame or one set for smaller parts of frame, for example one set for each half frame or one set for each sub-frame)

D. For each sub-frame perform the following steps:

D1. Search intra-lag for channel 1 ($lag_{11}$) only a few samples (for example 4–16) around estimate;

D2. Save a number (for example 24) lag candidates;

D3. Search intra-lag for channel 2 ($lag_{22}$) only a few samples (for example 4–16) around estimate;

D4. Save a number (for example 2–6) lag candidates;

D5. Search inter-lag for channel 1–channel 2 ($lag_{12}$) only a few samples (for example 4–16) around estimate;

D6. Save a number (for example 2–6) lag candidates;

D7. Search inter-lag for channel 2–channel 1 ($lag_{21}$) only a few samples (for example 4–16) around estimate;

D8. Save a number (for example 2–6) lag candidates;

D9. Perform complete search only for all combinations of saved lag candidates;

D10. Vector quantize LTP gains;

D11. Subtract contribution to excitation from adaptive codebook (for the just determined lags/gains) in remaining search in fixed codebook;

D12. Search fixed codebook 1 to find a few (for example 2–8) index candidates;

D13. Save index candidates:

D14. Search fixed codebook 2 to find a few (for example 2–8) index candidates;

D15. Save index candidates;

D16. Perform complete search only for all combinations of saved index candidates of both fixed codebooks;

D17. Vector quantize fixed codebook gains;

D18. Update LTP.

In the last described algorithm the search order of channels may be reversed from sub-frame to sub-frame.

If matrixing is used it is preferable to always search the "dominating" channel (sum channel) first.

Although the present invention has been described with reference to speech signals, it is obvious that the same principles may generally be applied to multi-channel audio signals. Other types of multi-channel signals are also suitable for this type of data compression, for example multi-point temperature measurements, seismic measurements, etc. In fact, if the computational complexity can be managed, the same principles could also be applied to video signals. In this case the time variation of each pixel may be considered as a "channel", and since neighboring pixels are often correlated, inter-pixel redundancy could be exploited for data compression purposes.

It will be understood by those skilled in the art that various modifications and changes may be made to the present invention without departure from the scope thereof, which is defined by the appended claims.

What is claimed is:

1. A multi-channel signal encoder including:

an analysis part including an analysis filter block having a first matrix-valued transfer function with at least one non-zero non-diagonal element; and a synthesis part including a synthesis filter block having a second matrix-valued transfer function with at least one non-zero non-diagonal element;

thereby reducing both intra-channel redundancy and inter-channel redundancy in linear predictive analysis-by-synthesis signal encoding.

2. The encoder of claim 1, wherein said second matrix-valued transfer function is the inverse of said first matrix-valued transfer function.

3. The encoder of claim 2, including a multi-channel long-term predictor synthesis block defined by:

$$[g_A \otimes \hat{d}]i(n)$$

where $g_A$ denotes a gain matrix, $\otimes$ denotes element-wise matrix multiplication, $\hat{d}$ denotes a matrix-valued time shift operator, and i(n) denotes a vector-valued synthesis filter block excitation.

4. The encoder of claim 3, including a multi-channel weighting filter block having a matrix-valued transfer function W(z) defined as:

$$W(z) = \begin{pmatrix} A_{11}^{-1}(z/\beta_{11}) & A_{12}^{-1}(z/\beta_{12}) & A_{13}^{-1}(z/\beta_{13}) & \cdots & A_{1N}^{-1}(z/\beta_{1N}) \\ A_{21}^{-1}(z/\beta_{21}) & A_{22}^{-1}(z/\beta_{22}) & A_{23}^{-1}(z/\beta_{23}) & \cdots & A_{2N}^{-1}(z/\beta_{2N}) \\ A_{31}^{-1}(z/\beta_{31}) & A_{32}^{-1}(z/\beta_{32}) & A_{33}^{-1}(z/\beta_{33}) & \cdots & A_{3N}^{-1}(z/\beta_{3N}) \\ \vdots & \vdots & \vdots & \vdots & \vdots \\ A_{N1}^{-1}(z/\beta_{N1}) & A_{N2}^{-1}(z/\beta_{N2}) & A_{N3}^{-1}(z/\beta_{N3}) & \cdots & A_{NN}^{-1}(z/\beta_{NN}) \end{pmatrix} \times \begin{pmatrix} A_{11}(z/\alpha_{11}) & A_{12}(z/\alpha_{12}) & A_{13}(z/\alpha_{13}) & \cdots & A_{1N}(z/\alpha_{1N}) \\ A_{21}(z/\alpha_{21}) & A_{22}(z/\alpha_{22}) & A_{23}(z/\alpha_{23}) & \cdots & A_{2N}(z/\alpha_{2N}) \\ A_{31}(z/\alpha_{31}) & A_{32}(z/\alpha_{32}) & A_{33}(z/\alpha_{33}) & \cdots & A_{3N}(z/\alpha_{3N}) \\ \vdots & \vdots & \vdots & \vdots & \vdots \\ A_{N1}(z/\alpha_{N1}) & A_{N2}(z/\alpha_{N2}) & A_{N3}(z/\alpha_{N3}) & \cdots & A_{NN}(z/\alpha_{NN}) \end{pmatrix}$$

where

N denotes the number of channels, $A_{ij}$, i=1 . . . N, j=1 . . . N denote transfer functions of individual matrix elements of said analysis filter block, $A^{-1}_{ij}$, i=1 . . . N, j=1 . . . N denote transfer functions of individual matrix elements of said synthesis filter block, and $\alpha_{ij}$, $\beta_{ij}$, i=1 . . . N, j=1 . . . N are predefined constants.

5. The encoder of claim 4, including a weighting filter block having a matrix-valued transfer function W(z) defined as:

$$W(z)=A^{-1}(z/\beta)A(z/\alpha)$$

where

A denotes the matrix-valued transfer function of said analysis filter block, $A^{-1}$ denotes the matrix-valued transfer function of said synthesis filter block, and $\alpha$, $\beta$ are predefined constants.

6. The encoder of any of the preceding claims, including means for determining multiple fixed codebook indices and corresponding fixed codebook gains.

7. The encoder of claim 3, including means for matrixing of multi-channel input signals before encoding.

8. The encoder of claim 7, wherein said matrixing means defines a transformation matrix of Hadamard type.

9. The encoder of claim 7, wherein said matrixing means defines a transformation matrix of the form:

$$\begin{pmatrix} 1 & 0 & 0 & \cdots & 0 \\ 1 & -gain_{22} & 0 & \cdots & 0 \\ 1 & -gain_{32} & -gain_{33} & \cdots & 0 \\ \vdots & \vdots & \vdots & \vdots & \vdots \\ 1 & -gain_{N2} & -gain_{N3} & \cdots & -gain_{NN} \end{pmatrix}$$

where $gain_{ij}$, i=2 . . . N, j=2 . . . N denote scale factors, and

N denotes the number of channels to be encoded.

10. A multi-channel linear predictive analysis-by-synthesis speech encoding method, comprising the steps of performing multi-channel linear predictive coding analysis of a speech frame; and, for each subframe of said speech frame:

estimating both inter and intra channel lags:

determining both inter and intra channel lag candidates around estimates;

storing lag candidates;

simultaneously and completely searching stored inter and intra channel lag candidates;

vector quantizing long term predictor gains;

subtracting determined adaptive codebook excitation;

determining fixed codebook index candidates;

storing index candidates;

simultaneously and completely searching said stored index candidates;

vector quantizing fixed codebook gains;

updating long term predictor.

11. A multi-channel linear predictive analysis-by-synthesis signal decoder including:

a synthesis filter block having a matrix-valued transfer function with at least one non-zero non-diagonal element.

12. The decoder of claim 11, including a multi-channel long-term predictor synthesis block defined by:

$$[g_A \otimes \hat{d}]i(n)$$

where $g_A$ denotes a gain matrix, $\otimes$ denotes element-wise matrix multiplication, $\hat{d}$ denotes a matrix-valued time shift operator, and i(n) denotes a vector-valued synthesis filter block excitation.

13. The decoder of claim 12, including means for determining multiple fixed codebook indices and corresponding fixed codebook gains.

14. A transmitter including a multi-channel speech encoder, including:

an speech analysis part including an analysis filter block having a first matrix-valued transfer function with at least one non-zero non-diagonal element; and a speech synthesis part including a synthesis filter block having a second matrix-valued transfer function with at least one non-zero non-diagonal element;

thereby reducing both intra-channel redundancy and inter-channel redundancy in linear predictive analysis-by-synthesis speech signal encoding.

15. The transmitter of claim 14, wherein said second matrix-valued transfer function is the inverse of said first matrix-valued transfer function.

16. The transmitter of claim 15, including a multi-channel long-term predictor synthesis block defined by:

$$[g_A \otimes \hat{d}]i(n)$$

where $g_A$ denotes a gain matrix, $\otimes$ denotes element-wise matrix multiplication, $\hat{d}$ denotes a matrix-valued time shift operator, and i(n) denotes a vector-valued speech synthesis filter block excitation.

17. The transmitter of claim 16, including a multi-channel weighting filter block having a matrix-valued transfer function W(z) defined as:

$$W(z) = \begin{pmatrix} A_{11}^{-1}(z/\beta_{11}) & A_{12}^{-1}(z/\beta_{12}) & A_{13}^{-1}(z/\beta_{13}) & \cdots & A_{1N}^{-1}(z/\beta_{1N}) \\ A_{21}^{-1}(z/\beta_{21}) & A_{22}^{-1}(z/\beta_{22}) & A_{23}^{-1}(z/\beta_{23}) & \cdots & A_{2N}^{-1}(z/\beta_{2N}) \\ A_{31}^{-1}(z/\beta_{31}) & A_{32}^{-1}(z/\beta_{32}) & A_{33}^{-1}(z/\beta_{33}) & \cdots & A_{3N}^{-1}(z/\beta_{3N}) \\ \vdots & \vdots & \vdots & \vdots & \vdots \\ A_{N1}^{-1}(z/\beta_{N1}) & A_{N2}^{-1}(z/\beta_{N2}) & A_{N3}^{-1}(z/\beta_{N3}) & \cdots & A_{NN}^{-1}(z/\beta_{NN}) \end{pmatrix} \times$$

$$\begin{pmatrix} A_{11}(z/\alpha_{11}) & A_{12}(z/\alpha_{12}) & A_{13}(z/\alpha_{13}) & \cdots & A_{1N}(z/\alpha_{1N}) \\ A_{21}(z/\alpha_{21}) & A_{22}(z/\alpha_{22}) & A_{23}(z/\alpha_{23}) & \cdots & A_{2N}(z/\alpha_{2N}) \\ A_{31}(z/\alpha_{31}) & A_{32}(z/\alpha_{32}) & A_{33}(z/\alpha_{33}) & \cdots & A_{3N}(z/\alpha_{3N}) \\ \vdots & \vdots & \vdots & \vdots & \vdots \\ A_{N1}(z/\alpha_{N1}) & A_{N2}(z/\alpha_{N2}) & A_{N3}(z/\alpha_{N3}) & \cdots & A_{NN}(z/\alpha_{NN}) \end{pmatrix}$$

where

N denotes the number of channels, $A_{ij}$, i=1 . . . N, j=1 . . . N denote transfer functions of individual matrix elements of said analysis filter block, $A^{-1}{}_{ij}$, i=1 . . . N, j=1 . . . N denote transfer functions of individual matrix elements of said synthesis filter block, and $\alpha_{ij}$, $\beta_{ij}$, i=1 . . . N, j=1 . . . N are predefined constants.

18. The transmitter of claim 17, including a weighting filter block having a matrix-valued transfer function W(z) defined as:

$$W(z)=A^{-1}(z/\beta)A(z/\alpha)$$

where

A denotes the matrix-valued transfer function of said speech analysis filter block, $A^{-1}$ denotes the matrix-valued transfer function of said speech synthesis filter block, and $\alpha$, $\beta$ are predefined constants.

19. The transmitter of any of the preceding claims 14–18, including means for determining multiple fixed codebook indices and corresponding fixed codebook gains.

20. The transmitter of any of the preceding claims 14–18, including means for matrixing of multi-channel input signals before encoding.

21. The transmitter of claim 20, wherein said matrixing means defines a transformation matrix of Hadamard type.

22. The transmitter of claim 20, wherein said matrixing means defines a transformation matrix of the form:

$$\begin{pmatrix} 1 & 0 & 0 & \cdots & 0 \\ 1 & -gain_{22} & 0 & \cdots & 0 \\ 1 & -gain_{32} & -gain_{33} & \cdots & 0 \\ \vdots & \vdots & \vdots & \vdots & \vdots \\ 1 & -gain_{N2} & -gain_{N3} & \cdots & -gain_{NN} \end{pmatrix}$$

where $gain_{ij}$, i=2 . . . N, j=2 . . . N denote scale factors, and

N denotes the number of channels to be encoded.

23. A receiver including a multi-channel linear predictive analysis-by-synthesis speech decoder, including:

a speech synthesis filter block having a matrix-valued transfer function with at least one non-zero non-diagonal element.

24. The receiver of claim 23, including a multi-channel long-term predictor synthesis block defined by:

$$[g_A \otimes \hat{d}]i(n)$$

where $g_A$ denotes a gain matrix, $\otimes$ denotes element-wise matrix multiplication, $\hat{d}$ denotes a matrix-valued time shift operator, and i(n) denotes a vector-valued speech synthesis filter block excitation.

25. The receiver of claim 24, including means for determining multiple fixed codebook indices and corresponding fixed codebook gains.

26. A multi-channel linear predictive analysis-by-synthesis speech encoding method, comprising the steps of performing multi-channel linear predictive coding analysis of a speech frame; and, for each subframe of said speech frame:

simultaneously and completely searching both inter and intra channel lags;

vector quantizing long term predictor gains;

subtracting determined adaptive codebook excitation;

completely searching fixed codebook, vector quantizing fixed codebook gains, updating long term predictor.

* * * * *

UNITED STATES PATENT AND TRADEMARK OFFICE

CERTIFICATE OF CORRECTION

PATENT NO. : 6,393,392 B1
DATED : May 21, 2002
INVENTOR(S) : Tor Björn Minde

It is certified that error appears in the above-identified patent and that said Letters Patent is hereby corrected as shown below:

Column 11,
Line 6, replace “for example 24” with -- for example 2-6 --

Column 13,
Line 55, replace “an speech analysis” with -- a speech analysis --

Column 16,
Line 19, replace “codebook” with -- codebook; --
Line 20, replace “gains” with -- gains; --

Signed and Sealed this

Thirty-first Day of December, 2002

JAMES E. ROGAN
*Director of the United States Patent and Trademark Office*